US010780329B2

(12) United States Patent
Ripp et al.

(10) Patent No.: US 10,780,329 B2
(45) Date of Patent: Sep. 22, 2020

(54) MULTI-COMPONENT GOLF CLUB WEDGE

(71) Applicant: Dunlop Sports Co., Ltd., Hyogo (JP)

(72) Inventors: Patrick Ripp, Huntington Beach, CA (US); Brian Herr, Huntington Beach, CA (US); Dan Nivanh, Huntington Beach, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 56 days.

(21) Appl. No.: 15/144,598

(22) Filed: May 2, 2016

(65) Prior Publication Data

US 2017/0095708 A1 Apr. 6, 2017

Related U.S. Application Data

(63) Continuation-in-part of application No. 14/876,731, filed on Oct. 6, 2015.

(51) Int. Cl.

| | |
|---|---|
| ***A63B 53/00*** | (2015.01) |
| ***A63B 53/04*** | (2015.01) |
| ***A63B 53/06*** | (2015.01) |
| *A63B 60/02* | (2015.01) |

(52) U.S. Cl.

CPC ..... *A63B 53/047* (2013.01); *A63B 53/06* (2013.01); *A63B 60/02* (2015.10); *A63B 2053/0408* (2013.01); *A63B 2053/0433* (2013.01); *A63B 2053/0479* (2013.01); *A63B 2053/0491* (2013.01); *A63B 2209/08* (2013.01)

(58) Field of Classification Search

CPC ..... A63B 53/047; A63B 2053/0408; A63B 2053/0433; A63B 2053/0479; A63B 2053/0491

USPC ..... 473/288, 334, 335, 328

See application file for complete search history.

(56) References Cited

U.S. PATENT DOCUMENTS

| | | | | |
|---|---|---|---|---|
| 2,332,342 A | | 10/1943 | Reach | |
| 3,220,733 A | | 11/1965 | Saleeby | |
| 4,708,347 A | * | 11/1987 | Kobayashi | A63B 53/04 473/338 |
| 5,301,944 A | * | 4/1994 | Koehler | A63B 53/04 473/328 |
| 5,776,010 A | * | 7/1998 | Helmstetter | A63B 53/04 473/334 |

(Continued)

OTHER PUBLICATIONS

US 8,777,770 B2, 07/2014, Yashiki (withdrawn)

*Primary Examiner* — John E Simms, Jr.

(74) *Attorney, Agent, or Firm* — Stetina Brunda Garred and Brucker; Mark B. Garred

(57) ABSTRACT

An iron-type golf club head assembly kit including a club head main body, a first sole component, and a second sole component interchangeably associable with the main body. When the first sole component is associated with the main body, the main body and the first sole component form a first club head comprising a sole surface having a first parting line, formed between the first sole component and the main body, and a first sole contour. When the second sole component is associated with the main body, the main body and the second sole component form a second club head comprising a second sole surface having a second parting line, formed between the second sole component and the main body, and a second sole contour that differs from the first sole contour.

11 Claims, 10 Drawing Sheets

(56) References Cited

U.S. PATENT DOCUMENTS 5,807,186 A * 9/1998 Chen ..... A63B 53/04 473/248
5,938,540 A * 8/1999 Lu ..... A63B 53/04 473/288
6,015,354 A 1/2000 Ahn et al.
6,224,493 B1 5/2001 Lee et al.
6,290,607 B1 9/2001 Gilbert et al.
6,569,029 B1 * 5/2003 Hamburger ..... A63B 53/047 473/238
6,616,547 B2 9/2003 Vincent et al.
7,083,530 B2 8/2006 Wahl et al.
7,121,956 B2 10/2006 Lo
7,166,041 B2 1/2007 Evans
7,189,169 B2 3/2007 Billings
7,201,669 B2 4/2007 Stites et al.
7,410,425 B2 8/2008 Willett et al.
7,410,426 B2 8/2008 Willett et al.
7,588,502 B2 9/2009 Nishino
7,628,711 B2 12/2009 Akinori et al.
7,691,004 B1 4/2010 Lueders
7,744,484 B1 6/2010 Chao
7,744,485 B2 6/2010 Jones et al.
7,758,452 B2 7/2010 Soracco
7,771,290 B2 8/2010 Bezilla et al.
7,789,771 B2 9/2010 Park et al.
7,815,519 B2 10/2010 Bryant et al.
7,846,033 B2 12/2010 Kato et al.
7,854,667 B2 12/2010 Gillig
7,871,338 B2 1/2011 Nakano
7,887,432 B2 2/2011 Jones et al.
7,887,435 B2 2/2011 Nishitani
7,892,106 B2 2/2011 Matsunaga
7,901,298 B2 3/2011 Sukman
7,922,603 B2 4/2011 Boyd et al.
7,967,699 B2 6/2011 Soracco
7,997,998 B2 8/2011 Bennett et al.
8,025,586 B2 9/2011 Teramoto
8,033,930 B2 10/2011 Tavares et al.
8,083,607 B2 12/2011 Clausen et al.
8,105,175 B2 1/2012 Breier et al.
8,133,128 B2 3/2012 Boyd et al.
8,142,308 B2 3/2012 Gillig
8,177,661 B2 5/2012 Beach et al.
8,192,302 B2 6/2012 Knutson et al.
8,197,358 B1 6/2012 Watson et al.
8,202,175 B2 6/2012 Ban
8,216,088 B2 7/2012 Hatton et al.
8,257,198 B2 9/2012 Gilbert et al.
8,262,497 B2 9/2012 Breier et al.
8,262,506 B2 9/2012 Watson et al.
8,292,757 B2 10/2012 Soracco
8,353,781 B2 1/2013 DeShiell et al.
8,376,878 B2 2/2013 Bennett et al.
8,382,604 B2 2/2013 Billings
8,382,606 B2 2/2013 Franklin et al.
8,388,465 B2 3/2013 De La Cruz et al.
8,409,028 B2 4/2013 Wahl et al.
8,409,031 B2 4/2013 Stites et al.
8,414,423 B2 4/2013 Hatton et al.
8,444,504 B2 5/2013 Chao et al.
8,449,406 B1 5/2013 Frame et al.
8,480,512 B2 7/2013 Oldknow et al.
8,491,405 B2 7/2013 Jorgensen et al.
8,491,413 B2 7/2013 Billings
8,496,541 B2 7/2013 Beach et al.
8,506,423 B2 8/2013 Oldknow et al.
8,512,164 B2 8/2013 Ines et al.
8,517,855 B2 8/2013 Beach et al.
8,545,343 B2 10/2013 Boyd et al.
8,550,933 B2 10/2013 Demkowski et al.
8,574,094 B2 11/2013 Nicolette et al.
8,613,676 B2 12/2013 Bentley
8,616,991 B2 12/2013 Billings
8,632,420 B2 1/2014 Kawaguchi et al.
8,636,606 B2 1/2014 Sato
8,668,598 B2 3/2014 Gilbert et al.
8,690,707 B2 4/2014 Stites et al.
8,690,708 B1 4/2014 Ehlers
8,696,491 B1 4/2014 Myers
8,702,533 B2 4/2014 Evans
8,715,105 B2 5/2014 Stites et al.
8,721,472 B2 5/2014 Kuan et al.
8,740,722 B2 6/2014 Sato
8,747,252 B2 6/2014 Lukasiewicz, Jr. et al.
8,747,253 B2 6/2014 Stites
8,753,225 B1 6/2014 Abbott et al.
8,753,226 B2 6/2014 Rice et al.
8,758,154 B2 6/2014 Demkowski et al.
8,758,163 B2 * 6/2014 Stites ..... A63B 53/047 473/332
8,777,774 B1 * 7/2014 Kim ..... A63B 53/06 473/334
8,821,307 B2 9/2014 Park et al.
8,834,294 B1 9/2014 Seluga et al.
8,840,485 B2 9/2014 Jorgensen et al.
8,876,624 B2 11/2014 Ban et al.
8,915,797 B1 * 12/2014 Kuhar ..... A63B 53/047 473/324
9,199,143 B1 * 12/2015 Parsons ..... A63B 53/0475
2003/0181259 A1 * 9/2003 Shimazaki ..... A63B 53/047 473/350
2008/0318706 A1 * 12/2008 Larson ..... A63B 53/047 473/334
2009/0120197 A1 5/2009 Golden et al.
2010/0029406 A1 * 2/2010 Stites ..... A63B 53/047 473/334
2010/0304883 A1 * 12/2010 Gilbert ..... A63B 53/047 473/324
2011/0021283 A1 * 1/2011 Hatton ..... A63B 53/047 473/291
2011/0086723 A1 * 4/2011 Gilbert ..... A63B 60/54 473/291
2011/0256953 A1 * 10/2011 Jorgensen ..... A63B 53/047 473/324
2012/0064996 A1 * 3/2012 Gilbert ..... A63B 53/047 473/349
2012/0064997 A1 * 3/2012 Sato ..... A63B 53/047 473/350
2012/0238375 A1 * 9/2012 Park ..... A63B 53/04 473/331
2013/0331201 A1 * 12/2013 Wahl ..... A63B 53/0475 473/329
2014/0106904 A1 * 4/2014 Park ..... A63B 53/0475 473/350
2015/0005099 A1 * 1/2015 Hettinger ..... A63B 53/047 473/350
2015/0038263 A1 * 2/2015 Ueda ..... A63B 53/04 473/349
2015/0231457 A1 * 8/2015 Sander ..... A63B 53/06 473/244
2016/0101330 A1 * 4/2016 Harrington ..... A63B 53/047 473/338
2016/0346638 A1 * 12/2016 Snyder ..... A63B 53/047

* cited by examiner

MULTI-COMPONENT GOLF CLUB WEDGE

CROSS-REFERENCE TO RELATED APPLICATIONS

This application is a continuation-in-part patent application of U.S. patent application Ser. No. 14/876,731 filed Oct. 6, 2015, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to a golf club head, and more specifically, to a golf club head having a main body adapted to be selectively attached to one of a plurality of detachable plates or inserts to modify the structural characteristics of the club head for purposes of achieving desired performance characteristics.

2. Description of the Related Art

It is well known that the physical properties of a golf club have a significant impact on how the club "feels" during use. One particular term commonly used in the golf industry in reference to the way a club performs or feels during use is the "effective bounce" of the golf club. The effective bounce of a golf club is typically not dictated by a single physical characteristic of the golf club. Rather, the effective bounce relates to several club head factors, such as the sole length, sole width, "take-off angle" (as described in further detail below), etc. A golfer's preferred effective bounce may be dictated by the golfer's particular swing characteristics, as well as the playing conditions of the golf course. For instance, low bounce wedges may be preferred for shots off tight lies and in bunkers with very little or very firm sand, as well as for golfers with very steep swings. High bounce wedges may be preferred from the rough, soft lies, bunkers with lots of sand or very soft sand, as well as for golfers with generally flat swings.

In view of the variability associated with effective bounce, golf club manufacturers have designed various club heads having different bounce characteristics. Bounce variability in club heads is particularly prevalent in relation to the design of wedge-type golf clubs. Along these lines, many currently commercially available wedges of a prescribed loft are provided in separate low, medium and high bounce models, the design of any particular wedge being limited to a prescribed effective bounce. Thus, if a golfer wants, for example, to take advantage of high bounce and low bounce wedges to accommodate e.g., differing course conditions, typically several different wedges of the same loft much be purchased since, as indicated above, current conventional wedge designs do not accommodate any bounce variability. Furthermore, players desiring to be fit for proper club head sole characteristics, e.g., bounce angle, are typically inconvenienced by a lack of test clubs have simple back and forth sole adjustment to accommodate such fitting.

Accordingly, there is a need for a club head, and more particularly a wedge, which provides adaptability in the effective bounce associated with the club head. Various aspects of the present disclosure address this particular need, as will be discussed in more detail below.

BRIEF SUMMARY

In accordance with one embodiment of the present disclosure, there is provided an iron-type (and more particularly a wedge-type) golf club head assembly kit including a main body, a first sole component and a second sole component interchangeably associable with the main body. The main body includes a striking face having a face center, a leading edge, a virtual striking face plane. The main body also has a rear surface opposite the striking face, and a hosel defining a hosel axis. When the first sole component is associated with the main body, the main body and the first sole component collectively form a first club head comprising a sole surface having a first parting line formed between the first sole component and the main body, and a first sole contour. When the first club head is oriented in a reference position, in a virtual central vertical plane passing through the face center and perpendicular to the striking face plane, in a direction perpendicular to the virtual striking face plane, the parting line is spaced rearwardly from the striking face by a distance D1 and the club head has a maximum depth D2 such that D1/D2 is no less than 0.40. When the second sole component is associated with the main body, the main body and the second sole component collectively form a second club head comprising a second sole surface having a second parting line, formed between the second sole component and the main body, and a second sole contour that differs from the first sole contour.

The golf club head assembly kit may further include a screw member having a screw head and a screw shaft that defines a screw shaft axis. The screw member may be configured to secure one of the first or second sole components to the main body to form a corresponding one of the first and second club heads such that when either of the first and second club heads is oriented in the reference position, the screw shaft axis intersects a virtual vertical hosel plane that contains the hosel axis at a screw shaft angle of between about 75° and about 110°.

When the golf club head assembly is configured as first club head, and such first club head is oriented in the reference position, in the virtual central vertical plane, and measured in the direction perpendicular to the virtual striking face plane: (a) the first sole component may further comprise a forward-most point defining a sole component forward plane parallel to the striking face plane and a rearward-most point defining a sole component rearward plane parallel to the striking face plane; (b) a plane passing through the first parting line and parallel to the striking face plane may be rearwardly spaced from the sole component forward plane by a distance D3; and (c) the sole component rearward plane may be rearwardly spaced from the sole component forward plane by a distance D4 such that D3/D4 is no less than 0.30.

When the first club head is oriented in the reference position, in the virtual central vertical plane, the parting line may be rearwardly spaced from the leading edge by a horizontal distance of no less than 0.35 in.

The first club head may further comprise a loft angle no less than 38°.

When respectively oriented in the reference position, the first club head may include a first leading edge height and the second club head may include a second leading edge height that differs from the first leading edge height by at least 0.15 mm.

According to another aspect of the disclosure, there is provided an iron-type golf club head, such as a wedge-type golf club head that, when oriented in a reference position, comprises a main body and a sole component removably secured to the main body. The main body includes a striking face having a face center, a leading edge, a virtual striking face plane. The main body also includes a rear surface opposite the striking face, and a hosel defining a hosel axis. A sole surface is collectively formed by the main body and the sole component, with the sole surface having a sole contour, and a first parting line formed between the sole component and the main body. In a virtual central vertical plane passing through the face center and perpendicular to the virtual striking face plane, measured in a direction perpendicular to the striking face, the parting line is spaced rearward from the striking face by a distance D1 and the club head has a maximum depth D2 such that D1/D2 is no less than 0.50.

It is contemplated that D1/D2 may be no less than 0.70.

The golf club head may further comprise a virtual vertical hosel plane that includes the hosel axis, and a fastener configured to secure the sole component to the main body.

In yet another implementation of the present disclosure, there is provided an iron-type golf club head, such as a wedge-type golf club head that, when oriented in a reference position, comprises a main body and a sole component removably secured to the main body. The main body includes a striking face having a face center, a leading edge, and a virtual striking face plane. The main body also includes a rear surface opposite the striking face, and a hosel defining a hosel axis. A sole surface is collectively formed by the main body and the sole component, with the sole surface having a sole contour and a first parting line formed between the first sole component and the main body. In a virtual central vertical plane passing through the face center and perpendicular to the virtual striking face plane, the parting line is spaced rearwardly from the striking face by a horizontal distance D5 that is no less than 0.35 in.

D5 may be between about 0.40 in and 0.70 in.

In the virtual central vertical plane, the sole surface may further comprise a sole surface horizontal length D6 such that D5/D6 is no less than 0.50. D5/D6 may also be no less than 0.60.

According to another aspect of the disclosure, there is provided an iron-type golf club head that, when oriented in a reference position relative to a virtual ground plane, comprises a main body including a topline, and a sole in generally opposed relation to the topline, with at least a portion of the sole resting on the ground plane when the golf club head is in the reference position. The main body further includes a striking face extending between the topline and the sole and a rear face in generally opposed relation to the striking face. A rear cavity extends from the rear face toward the striking face, and a sole cavity extends into the sole. The golf club head further comprises at least one rear plate removably secured within the rear cavity along a first axis, and at least one sole plate removably secured within the sole cavity. The golf club head includes a center of gravity vertically spaced from the virtual ground plane by between 13.5 mm and 16.0 mm.

The rear plate may include a first pair of opposed faces which are substantially parallel to each other to define a substantially uniform rear plate thickness therebetween. The sole plate may include a second pair of opposed faces which are substantially parallel to each other to define a substantially uniform sole plate thickness therebetween.

In accordance with an alternative implementation, the rear plate may include a pair of opposed faces which are non-parallel to each other to define a variable rear plate thickness therebetween. Furthermore, the sole plate may include a pair of opposed faces which are non-parallel to each other to define a variable sole plate thickness therebetween. At least one of the rear plate thickness and the sole plate thickness may vary in a vertical direction when the club head is in the reference position. At least one of the rear plate thickness and the sole plate thickness may vary in the heel to toe direction when the club head is in the reference position.

The club head may include at least one of a rear plate fastener configured to couple the at least one rear plate to the main body, and a sole plate fastener configured to couple the at least one sole plate to the main body. At least one of the rear plate fastener and the sole plate fastener may include a threaded screw member. At least one of the rear plate fastener and the sole plate fastener may include a magnet.

At least one of the at least one rear plate and the at least one sole plate may be formed from tungsten.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
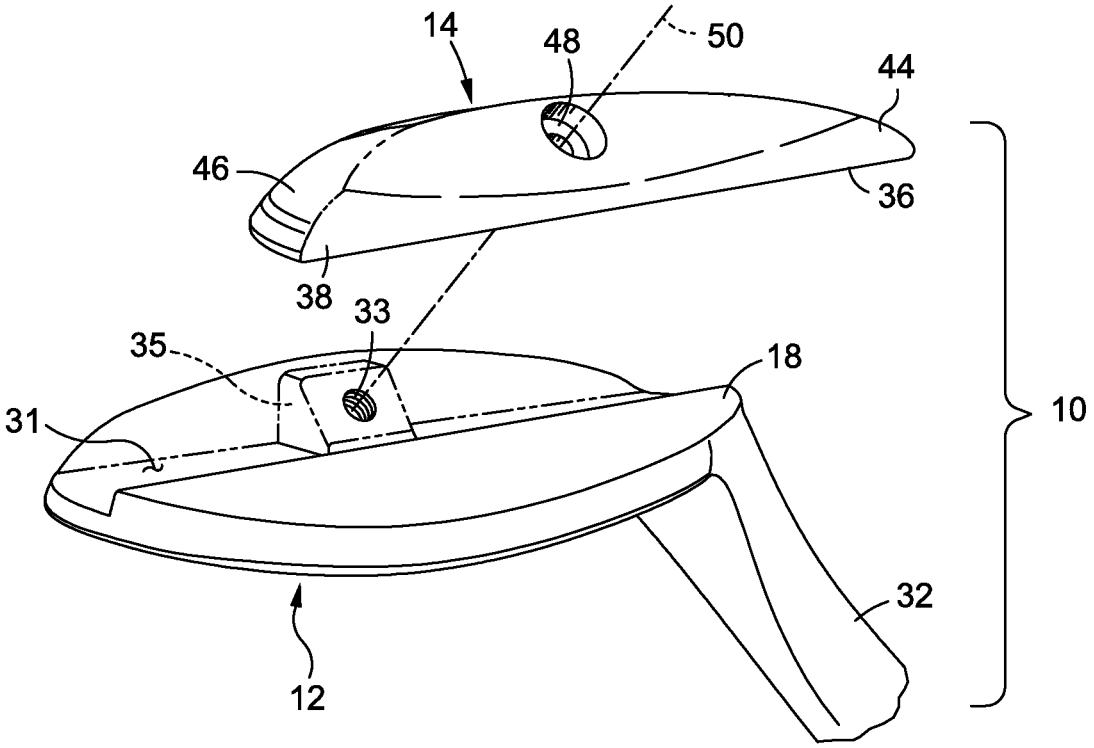
FIG. 1 is a rear exploded perspective view of an iron-type or wedge type golf club head having a detachable sole component exploded from a main body.
Figure 2:
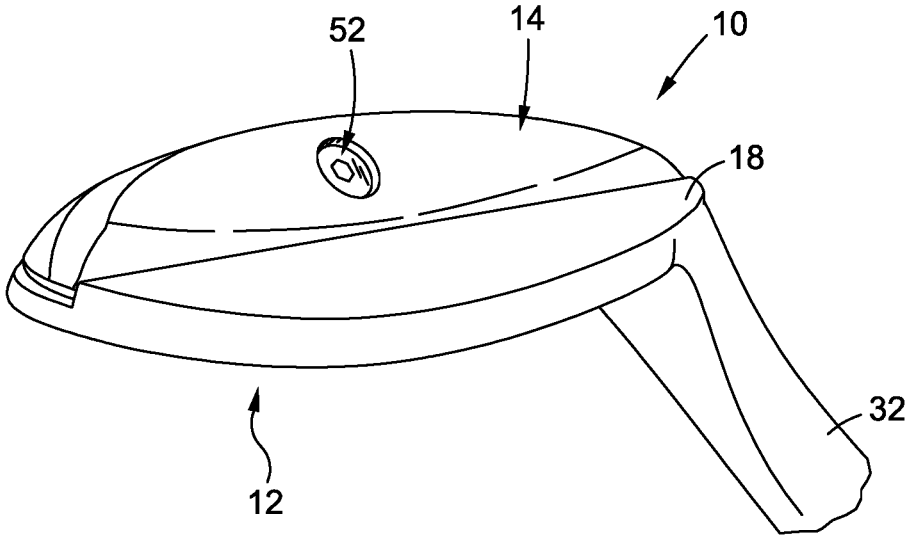
FIG. 2 is an assembled rear perspective view of the golf club head shown in FIG. 1.
Figure 3:
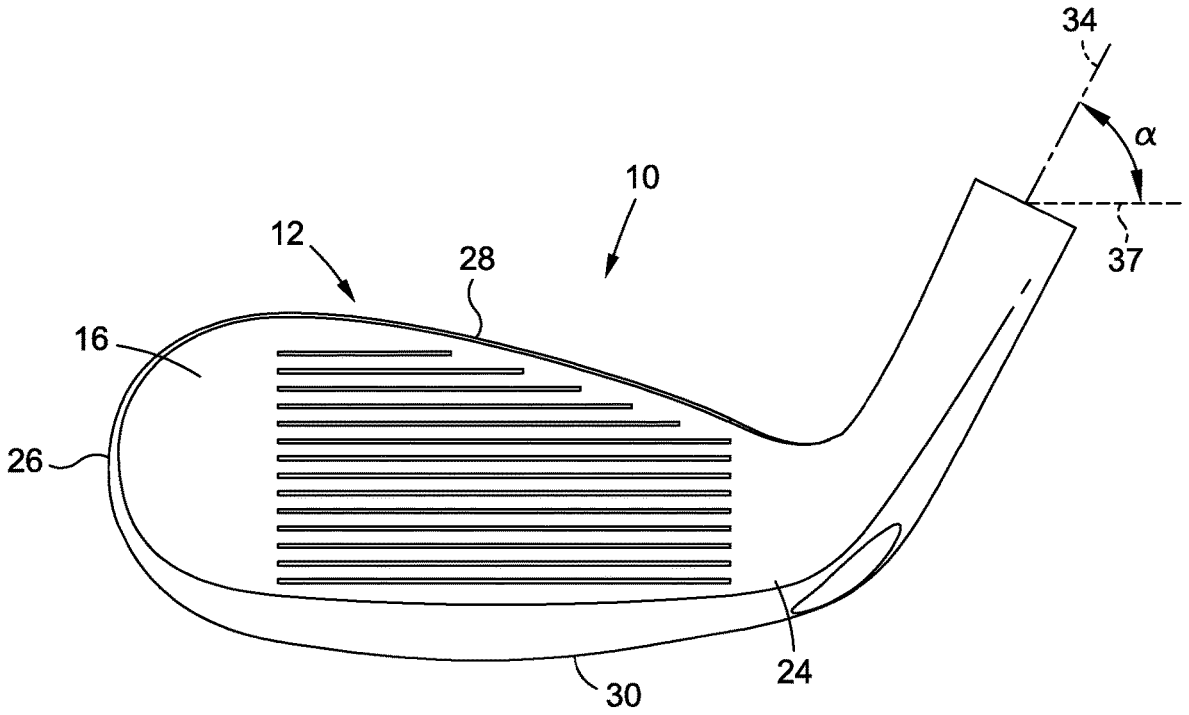
FIG. 3 is a front view of the golf club head shown in FIG. 2.

The detailed description set forth below in connection with the appended drawings is intended as a description of certain embodiments of an adjustable iron-type golf club head, and in particular an adjustable rear and/or sole portion of a wedge-type golf club head, and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. For example, while the present disclosure find particularly utility in relation to wedge type golf clubs, the structural and functional features described below may be applied to other iron-type golf club heads as well. It is further understood that the use of relational terms such as first and second, and the like are used solely to distinguish one entity from another without necessarily requiring or implying any actual such relationship or order between such entities. All recitations of parameter values as "approximate" values are intended to serve as implicit recitations of the precise values of such parameters as optional characteristics of the one or more embodiments to which they pertain.

Referring to FIGS. 1-4 and according to one embodiment, there is depicted a golf club head 10 having a main body 12 adapted to be interchangeably attachable to one of a plurality of different sole components to attain a preferred "feel" for the player using the club head 10 based e.g. on a prescribed alteration in the "bounce" of the club head. In particular, the different sole components each define different structural characteristics, such that each sole component provides a different bounce relative to the other sole components when attached to the main body 12. As described above, "bounce" as used herein denotes "effective bounce," which, as described above, may not connote a specific single measureable aspect of a sole, but rather generally pertains to aspects of a golf club sole surface that may contribute to the way the club head feels based on interaction with turf and the way the club may sit when resting on turf in a static position. Classifications of bounce may, in some cases, be based on a single factor, e.g. take-off angle (as described below). However, for practical purposes, "effective bounce" classification conventionally accounts for a number of sole surface aspects that may or may not include take-off angle, sole width, front-to-rear sole camber, and heel-to-toe sole camber. Preferably classifications of effective bounce (and in turn distinctions in one or more interchangeable sole portions having different "bounce" characteristics) include at least differences in "take-off angle" and/or sole width. The user may select a particular sole component based on the user's swing characteristics, playing environment, or other factors.

The golf club head 10 is an iron-type golf club head, and more particularly a wedge, with the main body 12 including a striking face 16 and a rear surface 18 in opposed relation to the striking face 16. The club head 10 preferably defines a blade portion being an upper portion and (via combination of the main body 12 and the sole component 14) a lower muscle portion associated with the blade portion. The blade portion preferably defines a striking wall thickness, "T," between the striking and rear faces 16, 18. According to various embodiments, the striking wall thickness T is preferably equal to approximately 0.15-0.50 inches, more preferably equal to 0.20-0.30 inches, and most preferably equal to approximately 0.22 inches. The striking face 16 includes a face center 20 and a leading edge 21, and defines a striking face plane 22, with the striking face 16 being adapted to repeatedly strike a golf ball during the lifespan of the club head 10. In this respect, the striking face 16 may include a plurality of grooves to impart spin to the golf ball on impact and/or to displace water or grass from the face 16 to allow for more direct impact between the club head 10 and the golf ball. The main body 12 further includes a heel 24, a toe 26, a top line 28, and an opposing sole 30. A recess 31 (see e.g. FIG. 1) extends into the main body 12 from the rear surface 18 adjacent the sole 30, and is adapted to at least partially receive the sole component 14, as will be described in more detail below. The main body 12 further includes a bore 33 extending into the main body 12 for attaching the sole component 14 to the main body 12. The bore 33 may be formed within a boss 35 which protrudes from the recess 31 in rearward direction. The main body 12 is fabricated from a metallic material, by forging, casting, or through other manufacturing techniques known in the art. A hosel 32 is coupled to the main body 12, extending from the heel 24 and defining a hosel axis 34. The hosel 32 is adapted to engage with a club shaft. The golf club head 10 is said to be in a "reference position" relative to a virtual ground plane, e.g. ground plane 37, when the hosel axis 34 is coplanar with an imaginary vertical hosel plane 35 that is perpendicular a virtual plane 22 that is perpendicular to the general plane of the striking face 16 and the scorelines extend generally parallel to the ground plane 37. Unless otherwise indicated, all parameters herein are specified with the golf club head 10 in the reference position.

Figure 4:
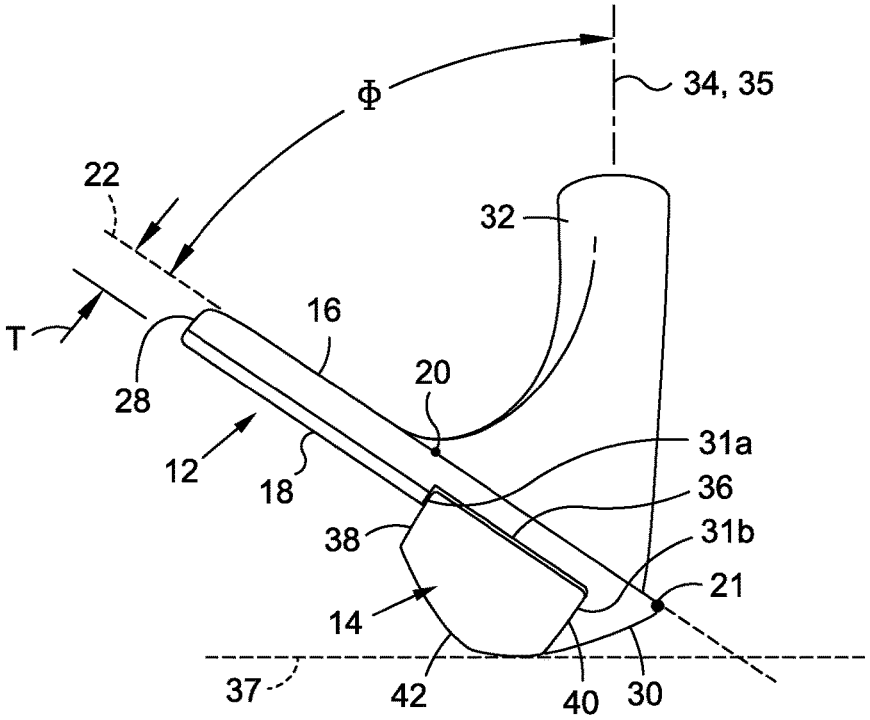
FIG. 4 is a toe side view of the golf club head shown in FIGS. 2 and 3 with the sole component being attached to the main body.

The main body 12 defines a loft angle, Φ, as the angle between the hosel plane 35 and the striking face plane 22, as shown in FIG. 4. According to various embodiments, the loft angle Φ is preferably no less than 38°, even more preferably greater than 40°, still more preferably between 45° and 70°, and even more preferably between 55° and 60° and most preferably equal to approximately 56°. Golf club heads, e.g., iron-type club heads, of lofts within these ranges are particularly apt for sole contour adjustment provided an increased tendency to "dig" into the ground.

As noted above, the main body 12 is specifically adapted for interchangeable use with a plurality of differently configured sole components 14, particular examples of which will be described in more detail below with reference to FIGS. 12-14. In this respect, the golfer may select which one of the plurality of sole components 14 to attach to the main body 12 to define the golf club head 10, with each sole component 14 providing unique bounce and hence "feel" attributes when attached to the main body 12. For instance, the different sole components 14 may have different dimensions and define different contours, which may create a distinctive feel of the club head 10. It is also contemplated that the sole components 14 may have different weights, densities, materials or other structural distinctions aimed at creating distinctive attributes to the club head 10, and notably the bounce characteristic described above.

In general, each sole component 14 includes an inner surface 36, a top surface 38, a bottom surface 40, and a rear surface 42, with the sole component 14 defining a heel portion and a toe portion. A counter-bore 48 is formed through the sole component 14 and defines a counter-bore axis 50, which passes through the rear surface 42 and the inner surface 36.

According to one embodiment, the sole component 14 may be attached to the main body 12 by positioning the sole component 14 within the recess 31, with the inner surface 36 of the sole component 14 facing the main body 12. The boss 35 may assist in properly locating the sole component 14 relative to the main body 12, such that the counter-bore 48 is coaxially aligned with the bore 33 formed on the main body 12. A mechanical fastener, such as a screw 52, may be used to secure the sole component 14 to the main body 12. The sole component 14 and main body 12 are preferably configured such that the sole component 14 abuts both an inner surface 36 of the recess 31, a recess upper sidewall 31*a* and a recess lower sidewall 31*b*. By configuring the sole component 14 to abut these respective recess sidewalls 31*a* and 31*b*, the sole component 14 and main body 12 combination may be more likely to behave as a solid component upon an impact of the club head 10 with a golf ball during typical play. For example, slight movement (which may result in clicking) of the sole component may be further minimized due to the abutment of plural surfaces that are angled relative to each other (as opposed to abutment generally about a surface in a single plane). In this regard, feel is improved, enabling such an adjustable club head to be more likely accepted as a replacement for a similar non-adjustable type club head (which may likely actually be formed of a single unitary component). As a corollary, by providing a more solid feel, such an adjustable club head, if used as a fitting tool, is more likely to feel like a conventional purchasable non-adjustable club head to which such adjustable club head may have been intended to correspond. In this case, a golfer undergoing a bounce fitting is less likely to be disappointed that an actual purchased club does not feel like a test club intended to represent the purchased club (or at a minimum feel that the fitting operation was of little value). In some embodiments, at least one of (and in some cases both of) the sidewalls 31*a* and 31*b* of the recess 31 is tapered in complementary manner to a tapered portion of the upper surface 38 and lower surface 40 of the sole component 14. In this manner, the association between the main body 12 and the sole component 14 may be made more snug and/or accommodate manufacturing tolerances. By solidly securing the sole portion 14 to the main body 12, generating relatively thin regions in the sole component 12 (e.g. to blend into the blade portion of the club head) may be avoided. Such thin portions may be associated with propagating unwanted vibrations upon impact of the striking face 16 with a golf ball in typical use.

Figure 5:
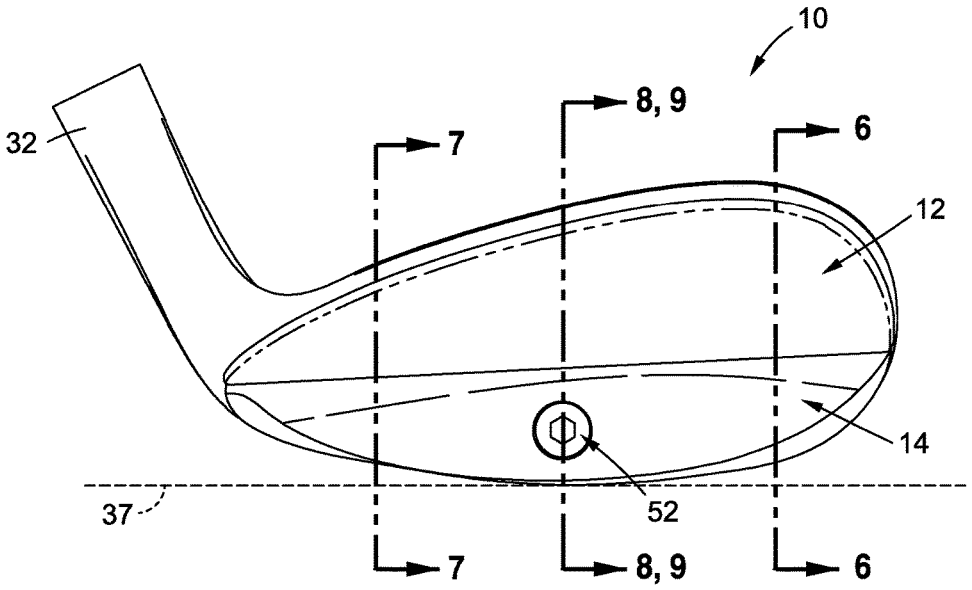
FIG. 5 is a rear view of the golf club head shown in FIGS. 2-4 with the sole component being attached to the main body.
Figure 6:
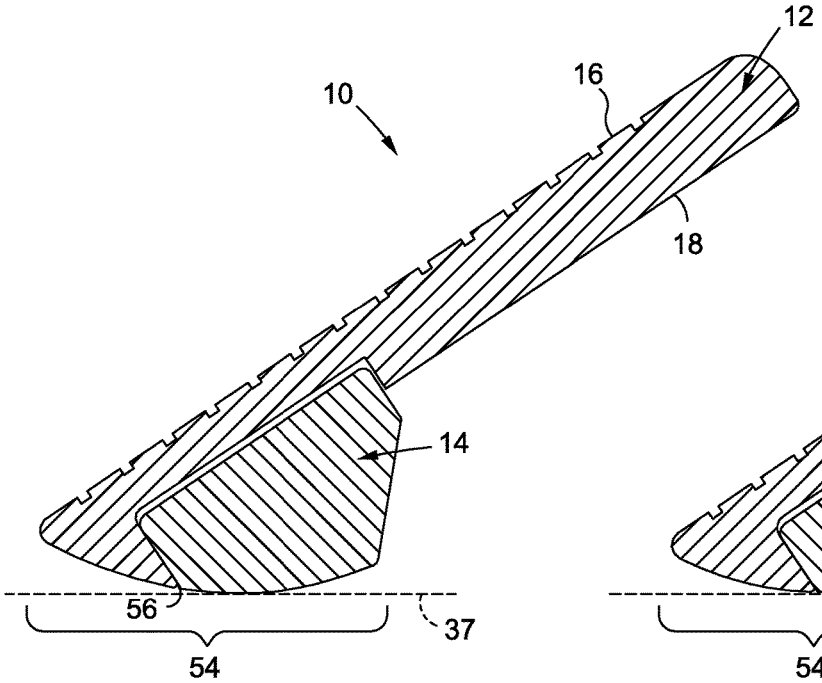
FIG. 6 is a side sectional view of the golf club head taken along line 6-6 as shown in FIG. 5.
Figure 7:
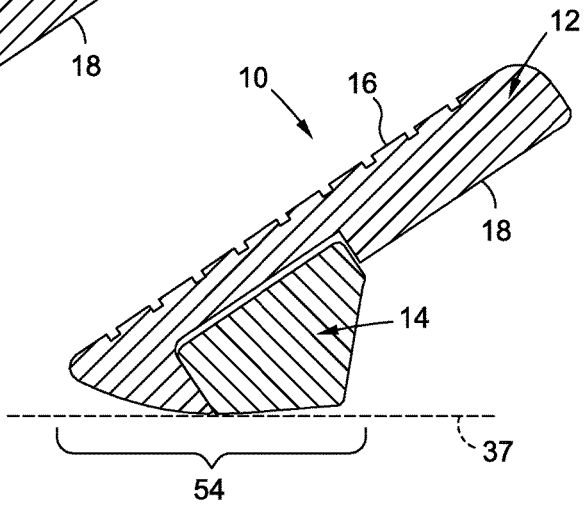
FIG. 7 is a side sectional view of the golf club head taken along line 7-7 as shown in FIG. 5.

Referring now to FIG. 5, there is depicted a rear view of the club head 10 having one prescribed sole component 14 attached to main body 12. FIG. 6 is a side sectional view of the club head 10 shown in a transverse plane located adjacent the toe of the club head 10, while FIG. 7 is a side sectional view of the club head 10 shown in the transverse plane located adjacent the heel of the club head 10. As is apparent, the size of the sole component 14 may vary in a heel to toe direction, with the sole component 14 having a larger cross sectional area proximate the heel than proximate the toe (and distal the heel).

The sole component 14 and main body 12, when attached to each other, collectively define a sole surface 54 having a sole contour including a parting line 56 at the intersection of the main body 12 and sole component 14. In view of the sole component 14 defining a portion of the sole surface 54, the contour of the sole surface 54 may be varied by interchanging one sole component 14 for another. Along these lines, a set of at least three sole components 14*a*, 14*b* and 14*c* are shown in FIGS. 12-14. The at least three sole components 14*a*, 14*b*, and 14*c* are interchangeably attachable to a main body 12 to vary contour of the sole surface formed between the main body 12 and the sole component (of the set of sole component 14*a*, 14*b*, and 14*b*) that is secured to the main body 12. When, for example, the first sole component 14*a* (FIG. 12) is attached to the main body 12, the first sole component 14*a* and main body 12 collectively form a first club head 10*a* including a first sole surface defining a first sole contour having a first parting line formed between the first sole component 14*a* and the main body 12. If the first sole component 14*a* is removed and replaced with, for example a second sole component 14*b* (FIG. 13), the main body 12 and the second sole component 14*b* collectively form a second club head 10*b*, which differs from the first club head 10*a*, and includes a second sole surface defining a second sole contour having a second parting line formed between the second sole component and the main body 12.

Figure 8:
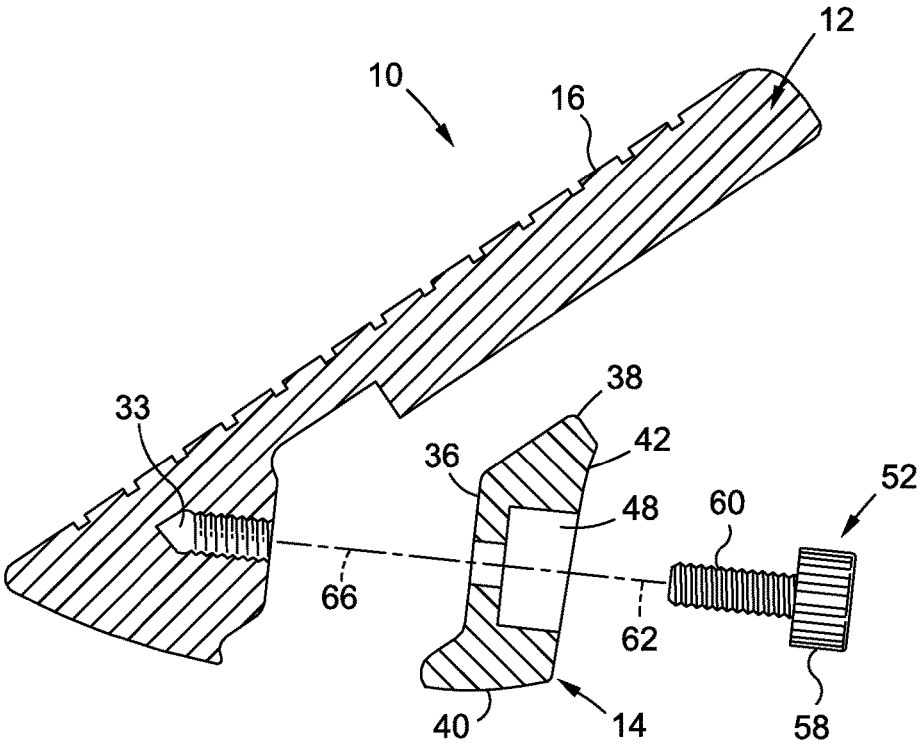
FIG. 8 is an exploded side sectional view of the golf club head taken along line 8-8 as shown in FIG. 5.
Figure 9:
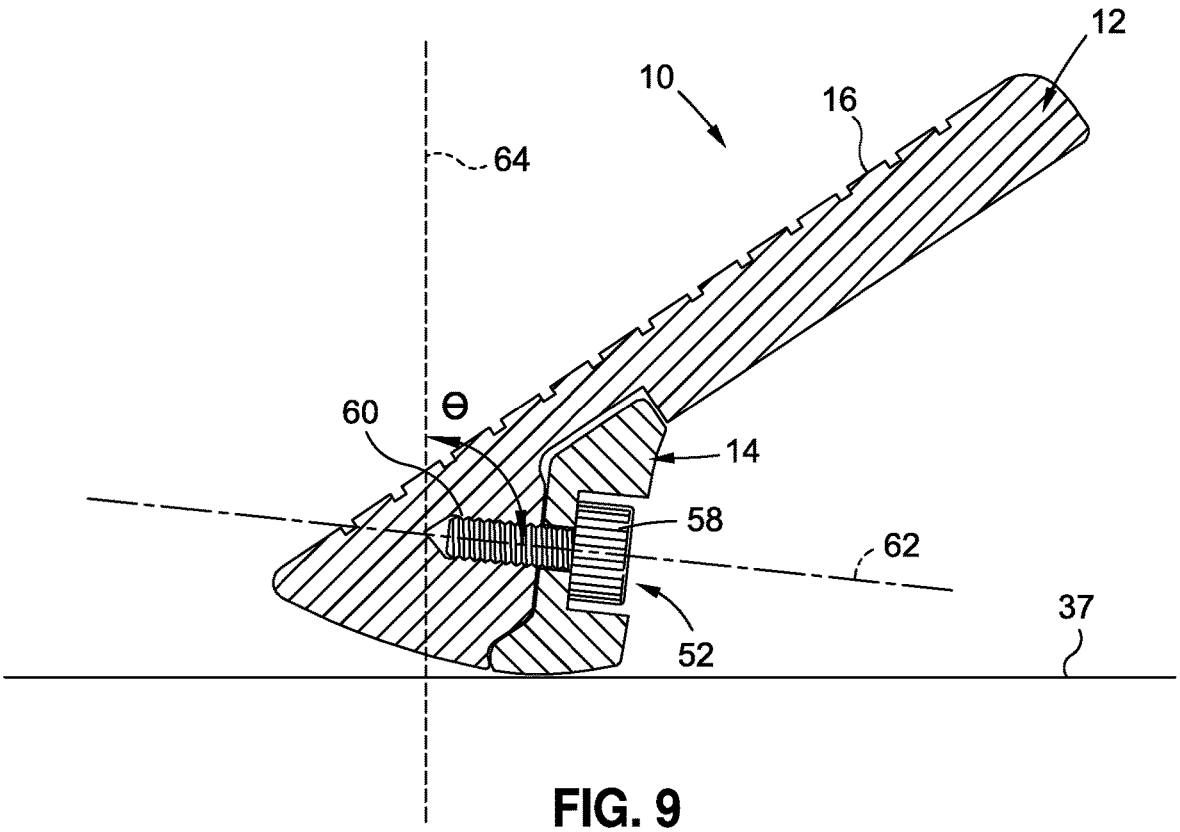
FIGS. 9-11 are assembled side sectional views of the golf club head taken along line 9-9 as shown in FIG. 5, each highlighting different parameters of the club head.
Figure 9A:
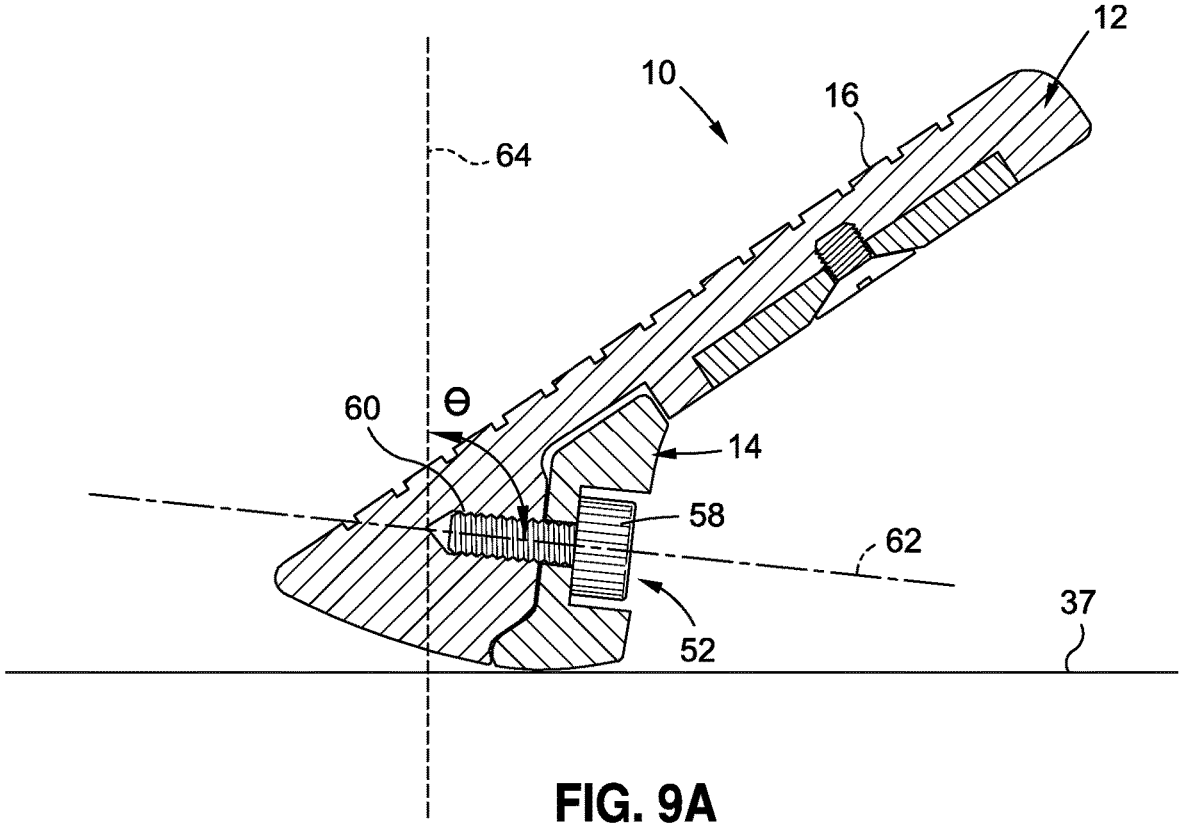

Referring now specifically to FIGS. 8 and 9, there is depicted cross sectional views of the club head 10 taken within a cross sectional vertical plane which passes through the face center 20 and is perpendicular to the striking face plane 22, with FIG. 8 depicting an exploded view and FIG. 9 depicting an assembled view. As can be seen, the sole component 14 is attached to the main body 12 via the screw member 52 having a screw head 58 and an externally threaded screw shaft 60 that defines a screw shaft axis 62. According to one embodiment, there are preferably no less than three threads on the screw shaft 60, and more preferably from 3-5 threads on the screw shaft 60. Of course, other embodiments may include more than 5 threads on the screw shaft 60 without departing from the spirit and scope of the present disclosure.

The screw member 52 is configured to secure the sole component 14 to the main body 12 to form the club head 10 such that, when the club head 10 is oriented in the reference position, the screw shaft axis 62 intersects a virtual vertical hosel plane 64 that contains the hosel axis at a screw shaft angle, Θ, of between about 75° and about 110°, more preferably between 80°-100°, and more preferably equal to about 90°. Along these lines, the bore 33 is internally threaded and configured to engage with the external threads on the screw shaft 60, with the bore 33 being disposed about a bore axis 66, which is equal to the screw shaft angle Θ. The bore 33 extends into the main body 12 deep enough to allow for a sufficient number of thread turns. The counter-bore 48 formed in the sole component 14 includes a first section that is of a first diameter larger than the diameter of the screw shaft 60 and smaller than the diameter of the screw head 58, and a second section that is of a second diameter larger than the diameter of the screw head 58, such that when the screw is completely advanced into the bore 33, the screw head 58 is received within the second section of the counter-bore 48, as shown in FIG. 9. According to one embodiment, the screw head 58 is a socket-style screw head, which matches the tool socket for adjustable/removable shaft securing screws, although it is understood that the screw head 58 may be a Phillips-head-style screw head, flat-head-style screw head, or a socket adapted to operably engage with a wrench, allen wrench, allen key, torx wrench, a wrench having a polygonal cross-section, a wrench having a proprietary cross-sectional shape, or other types of screw heads known in the art. In some embodiments a set of sole components may be offered in combination with the main 12 and/or a corresponding fastening tool to appropriately secure any of the sole components 14*a*, 14*b* and 14*c* to the main body 12. Such a tool may comprise a conventional screw driver, wrench, allen wrench, allen key, torx wrench, a wrench having a polygonal cross-section, a wrench having a proprietary cross-sectional shape, or the like. In one or more embodiments, the fastening tool includes a torque-sensing device and, optionally, an indicator for indicating, to the user, the current torque being applied to the fastener and/or when a threshold torque has been reached or exceeded. Furthermore, the main body 12 and sole component 14 are adapted to enable to the sole component 14 to be attached to the main body 12 via a single screw member 52, which provides simplicity and ease of use, and allows for quick and easy interchangeability of the sole component 14 to the main body 12. The configuration of the bore 33, counter-bore 48 and the screw member 52 may also reduce "clicking" during use by virtue of plural points of contact therebetween. This configuration, particularly the case in which the screw bore 33 extends from the rear surface of the sole component 14 at an angle within the ranges of angles described above, ensures that the screw enters the main body 12 in a location and in a direction aligned with a relative thick portion of the club head 12. This allows diminished presence of thin walls and/or unnecessary "hollowing" of the main body 12, which may promote beneficial feel. Also, orienting the screw bore 33 in this manner ensures that a relative lengthy portion of screw material is secured to the main body 12, further enabling a solid association of the sole component 14 and the main body 12, promoting beneficial feel and ensuring the structural integrity of the multi-component club head system.

It is also contemplated that an optional tape layer or other adhesives may be used in addition to the screw member 52 to couple the sole component 14 to the main body 12. The tape layer may improve the feel and further reduce "clicking," although in most instances, the use of the screw member 52 without an additional tape layer may be considered sufficient.

According to another embodiment, a captive screw may be used to secure the sole component 14 to the main body 12. The use of a captive screw may permit unthreading to remove the sole component 14 while keeping the screw retained in the main body 12.

It is further contemplated that the sole component 14 and main body 12 may be coupled using any fastening element or technique known in the art. For instance, the sole component 14 may be coupled to the main body 12 using one or more magnets, or a screw having a spring to enable quick release or quick-turn options in reducing the time associated with interchanging sole components.

Figure 10:
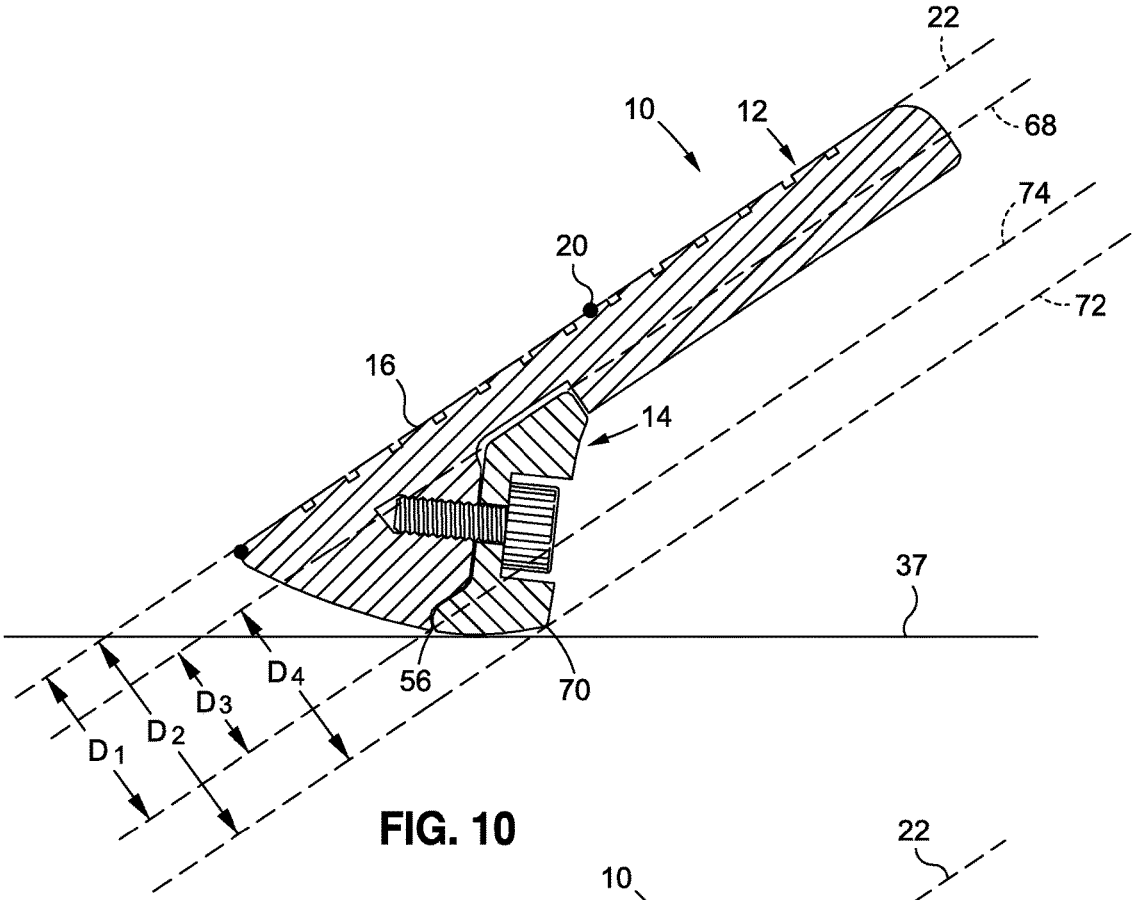
Figure 11:
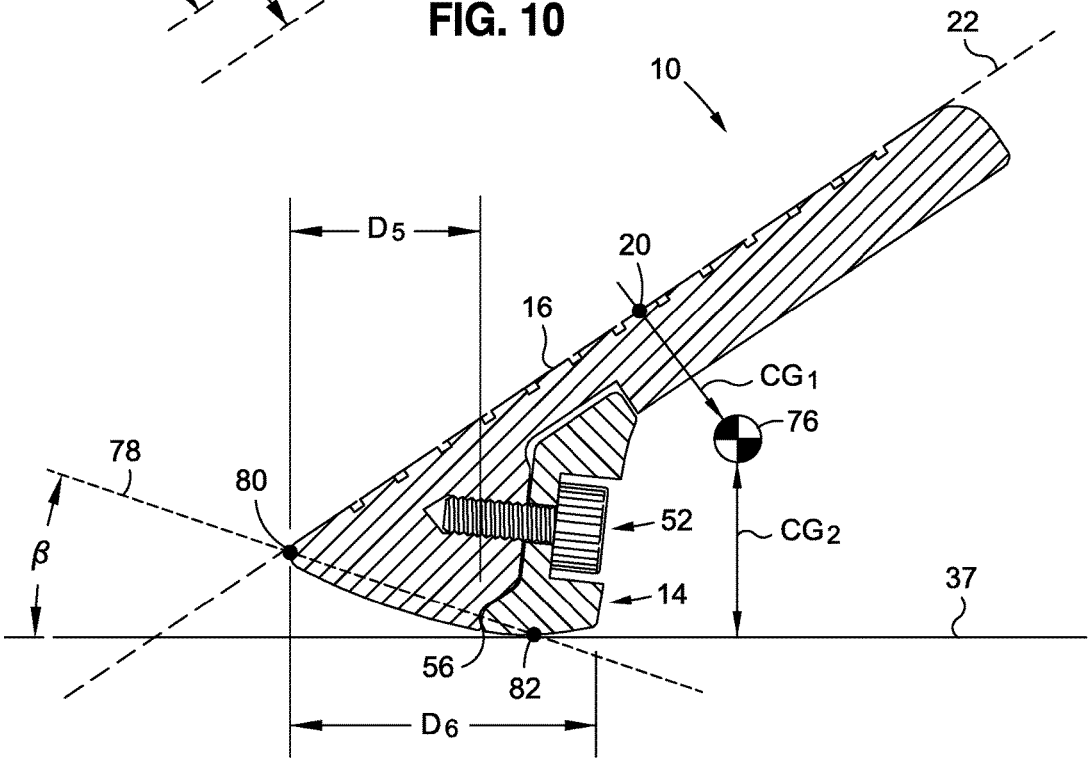

FIGS. 10 and 11 are reproductions of the club head 10 shown in FIG. 9, for purposes of illustrating various dimensions and parameters associated with the club head 10. With reference specifically to FIG. 10, the sole component 14 includes a forward-most point defining a sole component forward plane 68 parallel to the striking face plane 22 and a rearward-most point 70 defining a sole component rearward plane 72 parallel to the striking face plane 22. The club head 10 further includes a plane 74 passing through the parting line 56 and parallel to the striking face plane 22. The distance between the striking face plane 22 and the plane 74 passing through the parting line 56 defines a distance D1. The distance between the striking face plane 22 and the sole component rearward plane 72 defines a distance D2, and a maximum depth. The distance between the sole component forward plane 68 and the plane passing through the parting line 56 defines a distance D3. The distance between the sole component forward plane 68 and the sole component rearward plane 72 defines a distance D4.

According to one embodiment, the distance D1 is preferably greater than or equal to approximately 0.25 inches, and more preferably greater than or equal to approximately 0.35 inches, even more preferably between approximately 0.40 inches and 0.60 inches, still even more preferably between approximately 0.42 inches and 0.50 inches, and most preferably equal to approximately 0.47 inches.

According to another embodiment, the distance D2 is preferably greater than or equal to approximately 0.50 inches, more preferably between approximately 0.60 inches and 0.75 inches, and most preferably equal to approximately 0.63 inches.

According to still another embodiment, the distance D3 is preferably greater than or equal to approximately 0.25 inches, more preferably between approximately 0.30 inches and 0.40 inches, and most preferably equal to approximately 0.35.

According to yet another embodiment, the distance D4 is preferably greater than approximately 0.35 inches, more preferably between approximately 0.45 inches and 0.60 inches, and most preferably equal to approximately 0.51 inches.

In addition to the foregoing dimensions, there are several preferred ratios associated with the club head 10. According to one embodiment, the ratio of D1/D2 is preferably greater than or equal to approximately 0.40, more preferably greater than or equal to approximately 0.50, even more preferably greater than or equal to approximately 0.70, and most preferably equal to approximately 0.74. The ratio of D3/D4 is preferably greater than or equal to approximately 0.30, more preferably greater than or equal to approximately 0.50, even more preferably greater than or equal to 0.60, yet more preferably greater than or equal to approximately 0.65, and most preferably equal to approximately 0.68. By configuring the adjustable club head 10 in this regard, the parting line proximate the sole surface 54 is relatively rearward with respective to the club head 10. This minimizes the possibly-detrimental effect of the parting line on feel as it is located at or near a point of primary turf interaction. Accordingly, the above described configurations enable such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Referring now to FIG. 11, the club head 10 formed by the combined main body 12 and sole component 14 defines a center of gravity 76 which is spaced perpendicularly from the striking face plane 22 by a distance $CG_1$ and is elevated above the ground plane 37 by a distance $CG_2$. According to one embodiment, $CG_1$ is preferably equal to approximately 1-5 mm, more preferably equal to approximately 2-4 mm, and still more preferably equal to approximately 2.2 mm, while $CG_2$ is preferably equal to approximately 10-25 mm, more preferably equal to approximately 15-20 mm, and still more preferably approximately 17.5 mm. Configuring the adjustable club head 10 in this regard enables such adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Furthermore, FIG. 11 illustrates that in the virtual central vertical plane, the parting line 56 is spaced rearwardly from the leading edge 80 of the striking face by a horizontal distance, D5, and the sole surface comprises a sole surface horizontal length, D6. The distance D5 is preferably greater than or equal to approximately 0.35 inches, more preferably between approximately 0.40-0.70 inches, and most preferably equal to about 0.51 inches. The sole surface horizontal length D6 is preferably greater than or equal to approximately 0.50 inches, more preferably between approximately 0.70-1.00 inches, and most preferably equal to approximately 0.815 inches. According to one embodiment, the ratio of D5/D6 is greater than or equal to approximately 0.50, more preferably between approximately 0.55-0.70, even more preferably between approximately 0.60-0.65, and most preferably equal to approximately 0.63.

FIG. 11 further depicts a "take-off" angle, β, which is defined (in the virtual central vertical plane perpendicular to the striking face plan and passing through a ground contact point 82) as the angle between a line 78 (passing through the leading edge 80 and the ground contact point 82) and the ground plane 37. According to one embodiment, the take-off angle β is preferably equal to approximately 40-60°, more preferably equal to approximately 45-55°, and most preferably equal to approximately 51°.

The club head 10 preferably is of a head mass that is greater than or equal to approximately 200 g, more preferably between 240-300 g, even more preferably between 250-290 g, and most preferably equal to approximately 276 g. Furthermore, according to one embodiment, the moment of inertia through the center of gravity 76 about a vertical axis when the club head 10 is in the reference position is no less than approximately 3000 $g*cm^2$, more preferably no less than approximately 3400 $g*cm^2$, even more preferably between approximately 3500-3800 $g*cm^2$, and most preferably equal to approximately 3600 $g*cm^2$. By configuring the adjustable club head 10 in this regard, the feel of the club head may be more similar to a typical non-adjustable unitary club head, enabling such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Figure 12:
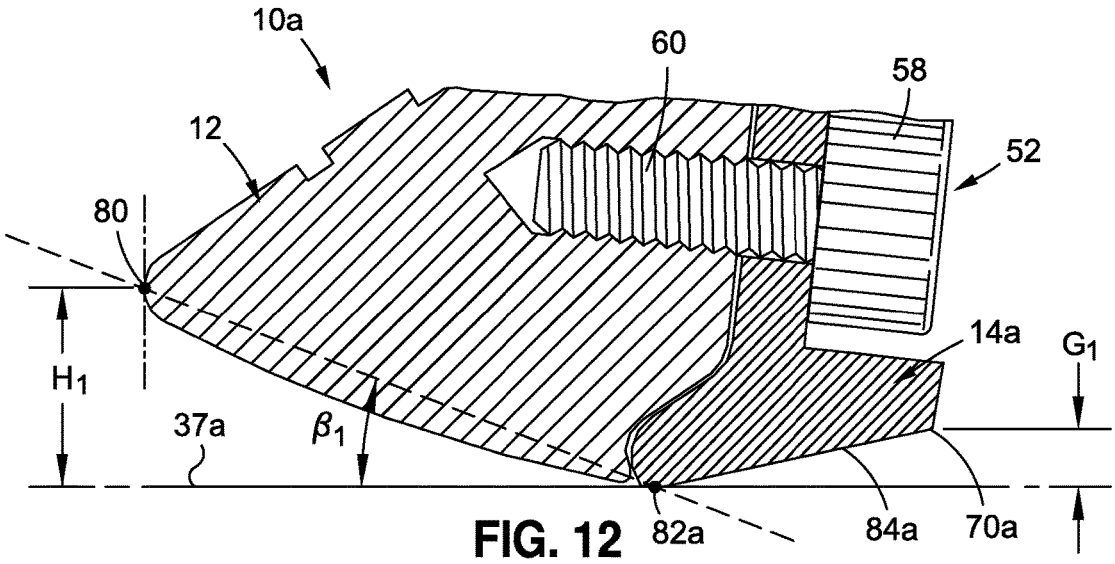
FIG. 12 is an enlarged, partial side sectional view of the club head having a first sole component coupled to the main body.
Figure 13:
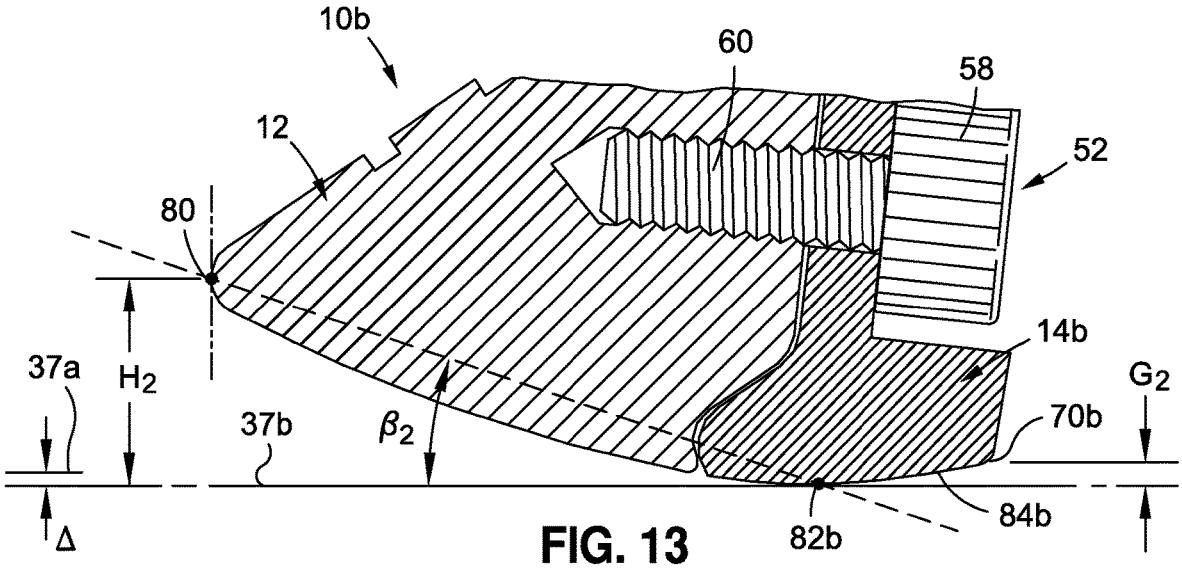
FIG. 13 is an enlarged, partial side sectional view of the club head having a second sole component coupled to the main body.
Figure 14:
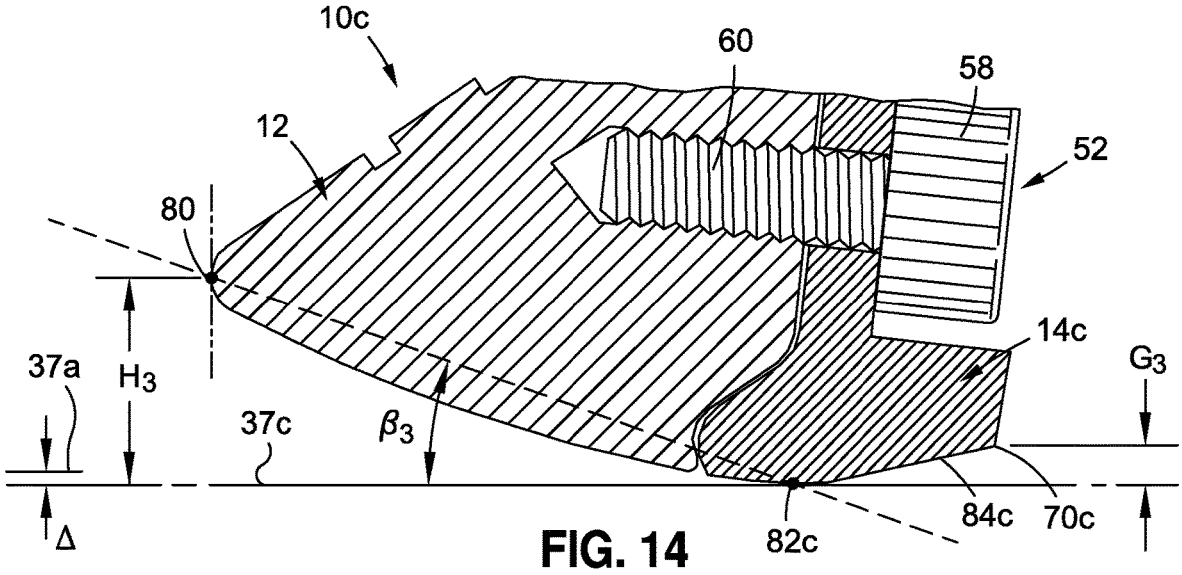
FIG. 14 is an enlarged, partial side sectional view of the club head having a third sole component coupled to the main body.

Referring now to FIGS. 12-14, there is depicted enlarged, partial, cross sectional views of three club heads 10*a*-10*c* formed with respective ones of three different, exemplary sole components 14*a*-14*c*. Referring first to FIG. 12, the first sole component 14*a* is coupled to the main body 12 to define the first club head 10*a*. The first sole component 14*a* defines a first ground contact point 82*a* where the first sole component 14*a* intersects with the ground plane 37*a*, which defines a first take-off angle, $\beta_1$, between the ground plane 37*a* and an axis passing through the first ground contact point 82*a* and the leading edge 80. The first ground contact point 82*a* and the leading edge 80 define a first leading edge height, $H_1$. The first sole component 14*a* further defines a first grind 84*a*, which extends rearwardly from the first ground contact point 82*a* and terminates at a first rearward-most point 70*a*, which is elevated above the ground plane 37*a* by a first grind height, $G_1$.

Referring now to FIG. 13, the second sole component 14*b* is coupled to the main body 12 to define the second club head 10*b*. The second sole component 14*b* defines a second ground contact point 82*b* where the second sole component 14*b* intersects with the ground plane 37*b*, which defines a second take-off angle, $\beta_2$, between the ground plane 37*b* and an axis passing through the second ground contact point 82*b* and the leading edge 80. The second ground contact point 82*b* and the leading edge 80 define a second leading edge height, $H_2$. The second sole component 14*b* further defines a second grind 84*b*, which extends rearwardly from the second ground contact point 82*b* and terminates at a second rearward-most point 70*b*, which is elevated above the ground plane 37*b* by a second grind height, $G_2$.

Referring now to FIG. 14, a third sole component 14*c* is coupled to the main body 12 to define a third club head 10*c*. The third sole component 14*c* defines a third ground contact point 82*c* where the third sole component 14*c* intersects with the ground plane 37*c*, which defines a third take-off angle, $\beta_3$, between the ground plane 37*c* and an axis passing through the third ground contact point 82*c* and the leading edge 80. The third ground contact point 82*c* and the leading edge 80 define a third leading edge height, $H_3$. The third sole component 14*c* further defines a third grind 84*c*, which extends rearwardly from the third ground contact point 82*c* and terminates at a third rearward-most point 70*c*, which is elevated above the ground plane 37*c* by a third grind height, $G_3$.

The first, second, and third sole components 14*a*-*c* each define respective contours, which modify the overall structural characteristics of the first, second, and third club heads 10*a*-*c*, with the aim being to provide different bounce characteristics for each club head 10*a*-*c*. In some cases, as shown a rear portion of the sole is ground to varying degrees. By increase the degree of grinding, the location of sole contact may vary, resulting in changes to take-off angle β and leading edge height H. More specifically, for instance, according to one embodiment, the location of the first ground contact point 82*a* relative to the main body 12 differs from the location of the second and third ground contact points 82*b*, 82*c*, with the location of the first ground contact point 82*a* being located closer to the leading edge 80 than the location of the second and third ground contact points 82*b*, 82*c*. Furthermore, the leading edge height may vary from one club head to the next. For instance, the first leading edge height $H_1$ may be smaller than the second and third leading edge heights $H_2$ and $H_3$. According to various embodiments, the first leading edge height $H_1$ varies from the second and/or third leading edge heights $H_2$, $H_3$ by an amount Δ, which is approximately equal to 0.15-0.40 mm, more preferably equal to approximately 0.20-0.25 mm, and most equal to approximately 0.218 mm. According to one embodiment, the first leading edge height $H_1$ is less than the second and/or third leading edge heights $H_2$, $H_3$ by the amount Δ. Moreover, the grind heights, $G_{1-3}$, may vary between the sole components 14*a-c*, such that in one implementation, the first grind height $G_1$ is greater than the second grind height $G_2$ and the third grind height $G_3$. By configuring the adjustable club head 10 in this regard, the feel of the club head may be more similar to a typical non-adjustable unitary club head, enabling such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

The various sole components 14*a-c* may provide certain benefits in different playing environments and/or for players having different swing characteristics. For instance, the first sole component 14*a* may be preferable when playing from firm conditions and tight lies. The first sole component 14*a* may also be more suitable for players with shallow attack angles. The second sole component 14*b* may be most accommodating for the largest variety of sand, turf and swing types. The third sole component 14*c* may be preferred when used on softer turf conditions and bunkers, or for use with players having a steep attack angle.

The ability to interchange the sole components 14*a-c* enables a user to easily test different feels, and thus, the sole components 14*a-c* effectively provide three club heads in one. A user may quickly move between different bounces with a single club by swapping one sole component 14 (e.g., sole components 14*a*, 14*b*, 14*c*) for another. Furthermore, it is easier to carry around several sole components 14 than it is to carry several different clubs, particularly around the course or on tour. The sole components 14 are also easier to manufacture at a lesser cost than entirely separate club heads. In addition, some golfers become accustomed to a particular striking face, which has been "worked" over a period of time, and thus, the golfer may be able to use different sole components 14 with the same striking face to achieve different bounce characteristics, rather than switching to an entirely different club.

It is contemplated that the various components described herein may be sold as a kit, wherein the main body 12 is sold with a plurality of sole components 14. The main body 12 may be sold in conjunction with a club shaft, or separate from a club shaft. It is further contemplated that the main body 12 and sole components 14 may be sold separate from each other.

Referring now to FIGS. 15-24, there is depicted another aspect of the present disclosure which provides further adaptability and customization of an iron-type golf club head 110. While the embodiments depicted in FIGS. 1-14 are primarily directed at varying the bounce of the club head through the use of interchangeable sole components 14, with one sole component 14 being attached to the club head at any given time, the club heads 110 depicted in FIG. 15-24 enable attachment of at least two plates or inserts 114, 116 to a club head main body 112 at any given time. Such adaptability may allow for additional customization (e.g., varying center of gravity location, creating desired weight distribution, etc.) to further accommodate the particular swing characteristics and preferences of the user. The plates 114, 116 may also allow a user to customize the look of the club head 110, as the plates 114, 116 may be formed from different colors, or have specific logos or indicia emblazoned thereon.

The club heads 110 shown in FIGS. 15-24 each generally include main body 112, a rear plate 114, and a sole plate 116, with both plates 114, 116 being selectively attachable to the main body 112. The main body 112 in each club head 110 shown in FIGS. 15-24 is identical, while the configuration of the rear plates 114 and sole plates 116 vary, as will be described in more detail below. The main body 112 of each club head 110 includes a topline 118 and a sole 120 in generally opposed relation to the topline 118, with at least a portion of the sole 120 resting on the ground plane 122 when the club head 110 is in the reference position. A striking face 124 extends between the topline 118 and the sole 120, and a rear face 126 is in generally opposed relation to the striking face 124.

The main body 112 cooperates with the rear plate 114 and the sole plate 116 via a rear cavity 128 and a sole cavity 130, respectively, which are separated from each other by a partition 132 extending across the rear of the club head 110 between the heel 134 and toe 136. According to one embodiment, when the club head 110 is in the reference position relative to the ground plane 122, the partition 132 extends between the heel 134 and the toe 136 in a generally horizontal direction.

The rear cavity 128 extends in a first direction into the main body 112 from the rear face 126 toward the striking face 124 and terminates at a rear recessed surface 138 to define a rear cavity depth. The rear cavity 128 also extends in a second direction from the partition 132 toward the topline 118, with the upper periphery 128*a* of the rear cavity 128 being similar in shape to, e.g. parallel with, the topline 118. In this regard, the periphery of the rear cavity 128 adjacent the partition 132 (i.e. the lower periphery portion 128*b*) follows a generally linear path. In this manner, the lower periphery portion 128*b* of the rear cavity 128 generally follows, e.g. is parallel with, the junction between the blade portion of the club head and the muscle portion of the club head 110. In the particular embodiment shown in FIG. 15, such junction is generally linear. However, in other embodiments, the junction between a club head blade portion and a muscle portion may be arcuate, having e.g. upward concavity or upward convexity. In such cases, the lower periphery 128*b* of the rear cavity 128 preferably follows the path of such junction. For example, in embodiments where the junction follows an upwardly concave path, the lower periphery 128*b* of the rear cavity 128 also preferably follows an upwardly concave path. In embodiments in which such junction follows an upwardly convex path, the lower periphery 128*b* of the rear cavity 128 also follows an upwardly convex path. These configurations ensure that maximum space is dedicated to removable mass, providing for a greater range of customizability. Of course, in alternative embodiments, the path of the lower periphery 128*b* of the rear cavity 128 does not follow the path of the junction between the blade portion and muscle portion of the club head 110 and may, for example, follow a mirror-image path. Similarly, in alternative embodiments, the path of the upper periphery portion 128*a* of the rear cavity 128 does not generally follow the path of the top line 118, and may, for example, follow a mirror-image path. One or more threaded cavities or recesses may further extend into the main body 112 from the rear recessed surface 138 to facilitate attachment of the rear plate 114 to the main body 112 through the use of a mechanical fastener, as will be described in more detail below.

The sole cavity 130 extends into the sole 120 in a first direction from a sole rear surface 140 and terminates at a sole recessed surface 142 and in a second direction from the partition 132 toward a sole bottom surface 144. In this regard, the periphery 130*a* of the sole cavity 130 adjacent the partition 132 (i.e. the upper periphery portion 130*a*) follows a generally linear path. In this manner, the upper periphery portion 130*a* of the sole cavity 130 generally follows, e.g. is parallel with, the junction between the blade portion of the club head and the muscle portion of the club head 110. In the particular embodiment shown in FIG. 15, such junction is generally linear. However, in other embodiments, the junction between a club head blade portion and a muscle portion may be arcuate, having e.g. upward concavity or upward convexity. In such cases, the upper periphery 130*a* of the sole cavity 130 preferably follows the path of such junction. For example, in embodiments where the junction follows an upwardly concave path, the upper periphery 130*a* of the sole cavity 130 also preferably follows an upwardly concave path. In embodiments in which such junction follows an upwardly convex path, the upper periphery 130*a* of the sole cavity 130 also follows an upwardly convex path. These configurations ensure that maximum space is dedicated to removable mass, providing for a greater range of customizability. Of course, in alternative embodiments, the path of the upper periphery 130*a* of the sole cavity 130 does not follow the path of the junction between the blade portion and muscle portion of the club head 110 and may, for example, follow a mirror-image path. Similarly, in alternative embodiments, the path of the lower periphery portion 130*b* of the sole cavity 130 does not generally follow the path of the junction line between the sole portion 120 and the rear surface 140, and may, for example, follow a mirror-image path. One or more threaded cavities or recesses may further extend into the main body 112 from the sole recessed surface 142 to facilitate attachment and detachment of the sole plate 116 to the main body 112 through the use of a mechanical fastener.

The configuration of the main body 112 described above can be used with any of the rear plates 114 or sole plates 116 shown in FIGS. 15-24 and described in more detail below.

Figure 15:
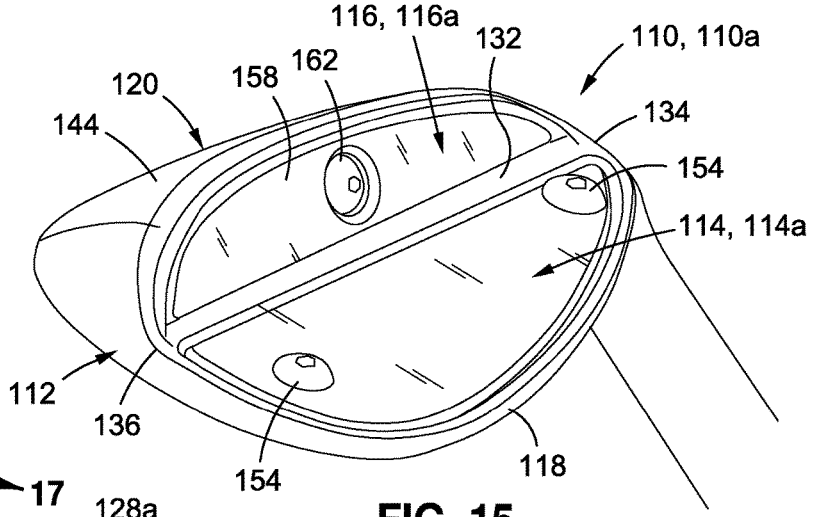
FIGS. 15 and 16 are perspective views of a club head having a main body and a first embodiment of a rear plate and sole plate set attached to the main body.
Figure 16:
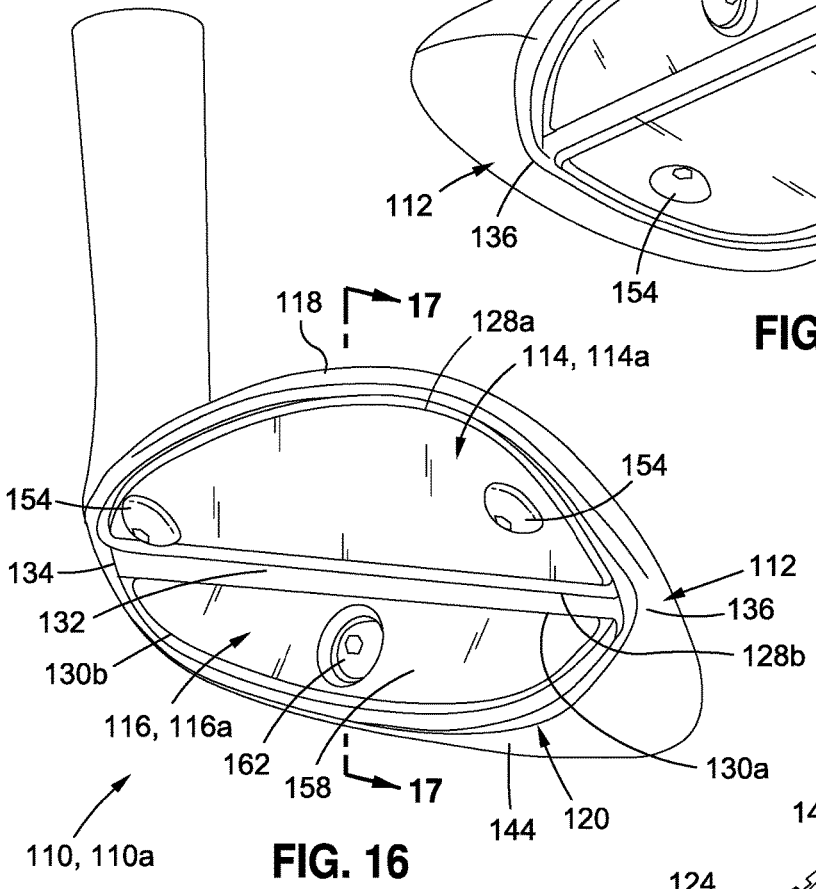
Figure 17:
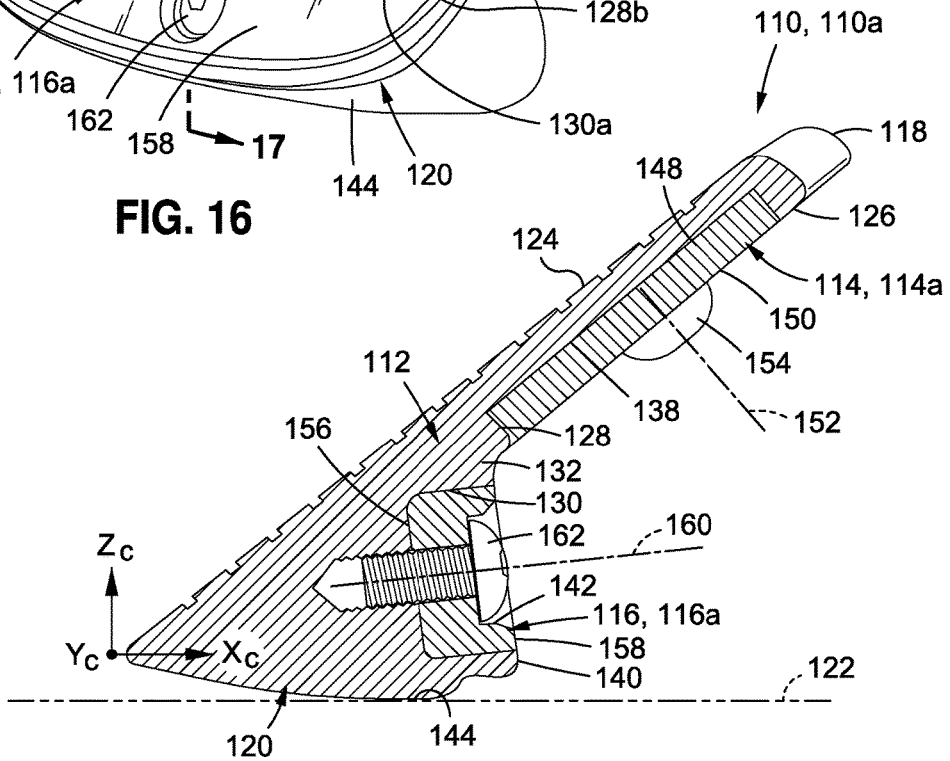
FIG. 17 is a cross sectional view of the club head depicted in FIGS. 15 and 16.

Referring first to FIGS. 15-17, there is shown a club head 110*a* as a species of the club head 110 and outfitted with a rear plate 114*a* as a species of the rear plate 114 and a sole plate 116*a* as a species of the sole plate 116. In the club head 110*a*, the rear plate 114*a* and sole plate 116*a* have a substantially constant thickness throughout. The rear plate 114*a* is complementary in shape to the rear cavity 128 and includes a first face 148 and an opposing second face 150 to define a rear plate thickness therebetween. In the embodiment depicted in FIGS. 15-17, the distance between the first face 148 and the second face 150 remains generally constant across the entirety of the rear plate 114*a*. In this regard, the distance remains the same in a topline-to-sole direction, as well as in a heel-to-toe direction. The rear plate 114*a* includes a generally linear edge which is positioned adjacent the partition 132 and an arcuate or curved edge which is placed adjacent the topline 118.

The rear plate 114*a* is configured to be removably secured within the rear cavity 128. In some embodiments, the rear plate 114*a* includes a throughbore for receiving a fastener 154 therethrough. The fastener 154 preferably include a threaded screw defining a shaft axis coincident with a rear cavity axis 152. The rear plate 114 may include a pair of openings or such throughbores, which are aligned with corresponding recesses formed on the main body 112 to enable a pair of rear plate fasteners 154, such as a screw or other mechanical fastener to be received therein for securing the rear plate 114*a* to the main body 112. In cases in which the fasteners include plural threaded screws, each define screw axes that are parallel to each other. It is also contemplated that tape, magnets or other fasteners known in the art may be used to secure the rear plate 114*a* to the main body 112.

The sole plate 116*a* is complementary in shape to the sole cavity 130 and includes a first face 156 and an opposing second face 158 to define a sole plate thickness therebetween. In the embodiment depicted in FIGS. 15-17, the distance between the first face 156 and the second face 158 remains generally constant across the entirety of the sole plate 116*a*. In this regard, the distance remains the same in a topline-to-sole direction, as well as in a heel-to-toe direction. The sole plate 116*a* includes a generally linear edge which is positioned adjacent the partition 132 and an arcuate or curved edge which is placed adjacent the sole bottom surface 144.

The sole plate 116*a* is configured to be removably secured within the sole cavity 130. In some embodiments, the sole plate 116*a* includes a throughbore for receiving a fastener 162 therethrough. The fastener 162 preferably includes a threaded screw defining a shaft axis coincident with a sole cavity axis 160, which is angularly offset from the rear cavity axis 152. It is also contemplated that tape, magnets or other fasteners known in the art may be used to secure the sole plate 116*a* to the main body 112. In cases in which the fasteners include plural threaded screws, each define screw axes that are parallel to each other.

The rear and sole plates 114*a*, 116*a* may be configured to have respective thicknesses which fill the corresponding rear and sole cavities 128, 130, exceed the rear and sole cavities 128, 130, or alternatively, only partially fill the rear and sole cavities 128, 130. Preferably, the rear and sole plates 114, 116 fill the rear sole cavities 128, 130, respectively, such that their exterior surfaces are substantially flush (e.g. allowing for tolerances in manufacturing) with respective adjacent surrounding exterior surfaces of the club head 110. Such provides for retention of the tradition appearance of the club head, promoting confidence, and minimizes sharp contours which may collect debris.

Figure 18:
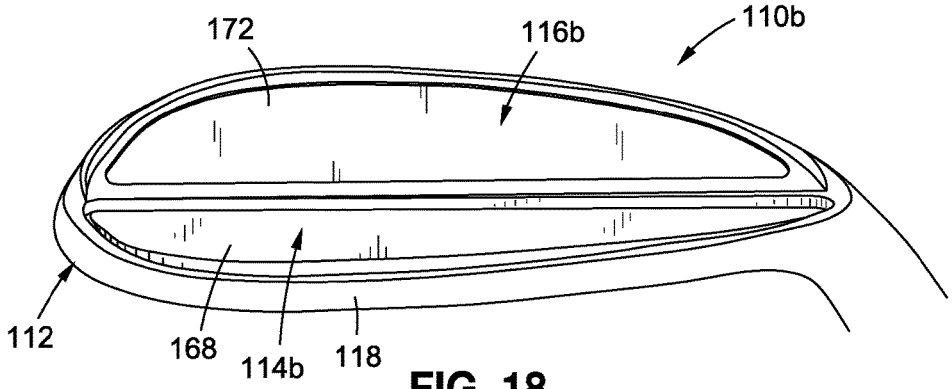
FIGS. 18 and 19 are perspective views of a club head having a main body and a second embodiment of a rear plate and sole plate set attached to the main body.
Figure 19:
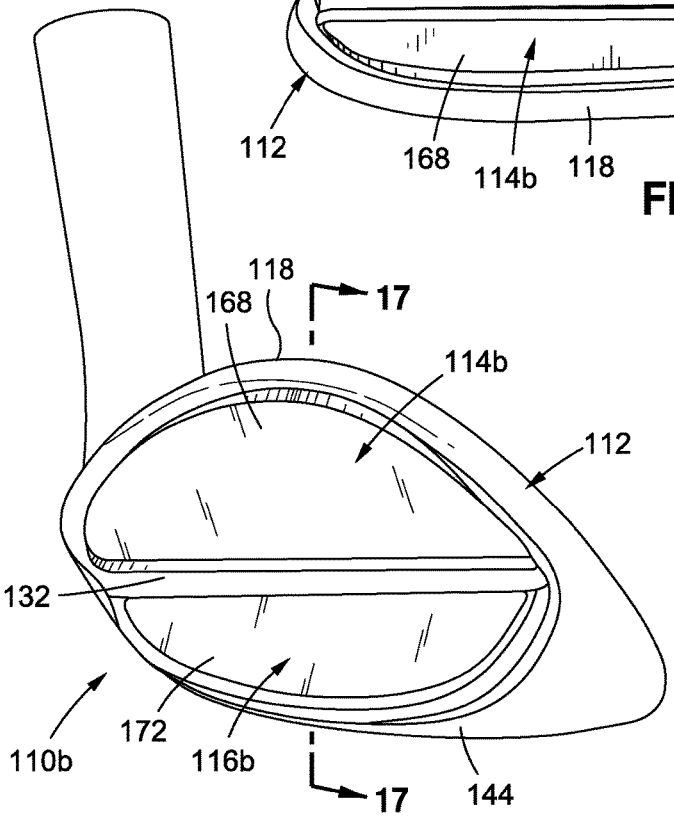
Figure 20:
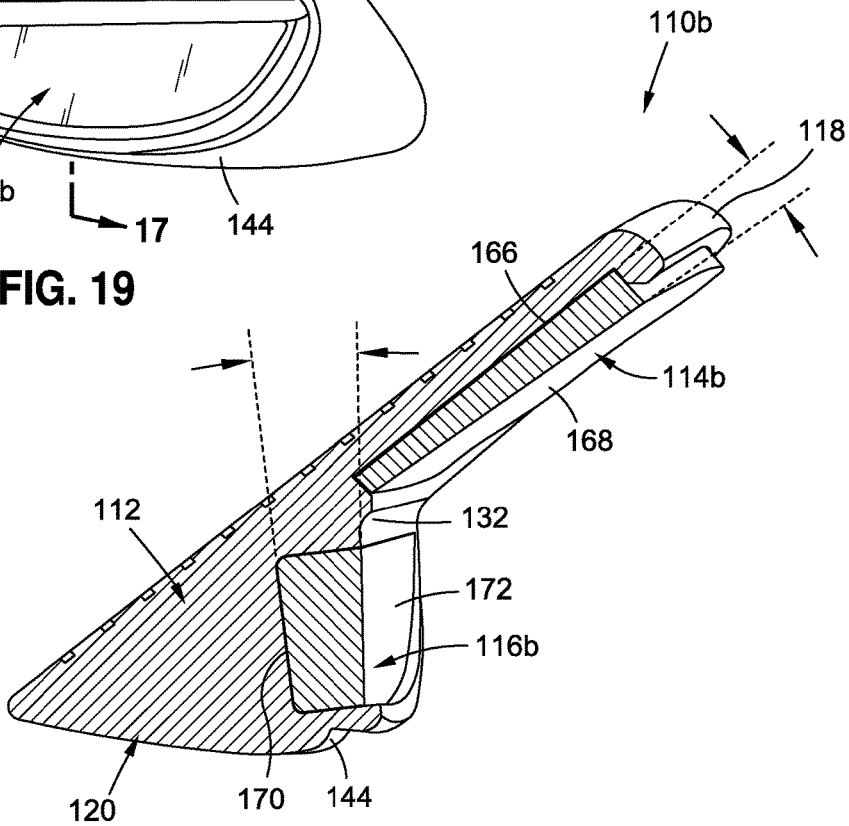
FIG. 20 is a cross sectional view of the club head depicted in FIGS. 18 and 19.
Figure 21:
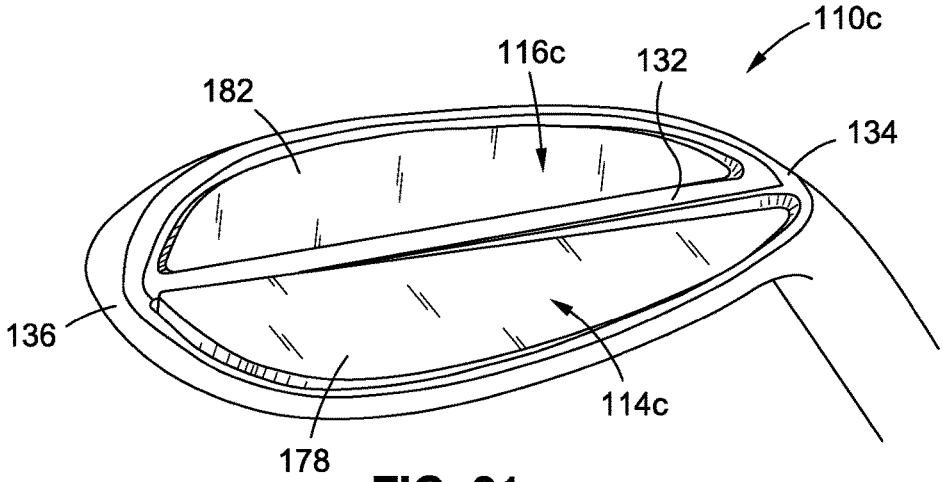
FIGS. 21 and 22 are perspective views of a club head having a main body and a third embodiment of a rear plate and sole plate set attached to the main body.
Figure 22:
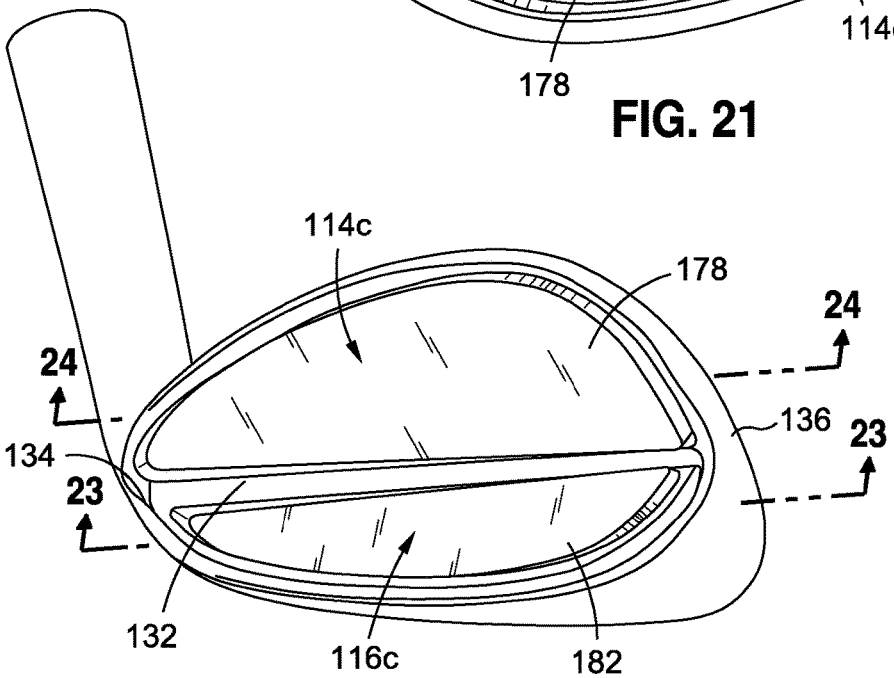
Figure 23:
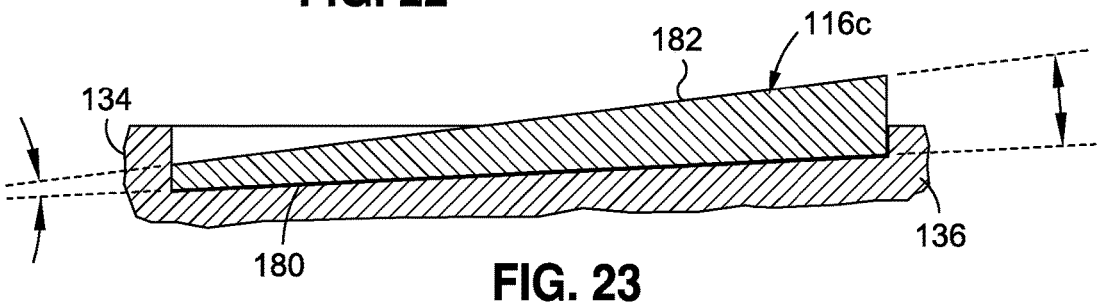
FIG. 23 is a cross sectional view of the club head depicted in FIGS. 21 and 22 taken within a first cross sectional plane to depict the sole plate coupled to the main body.
Figure 24:
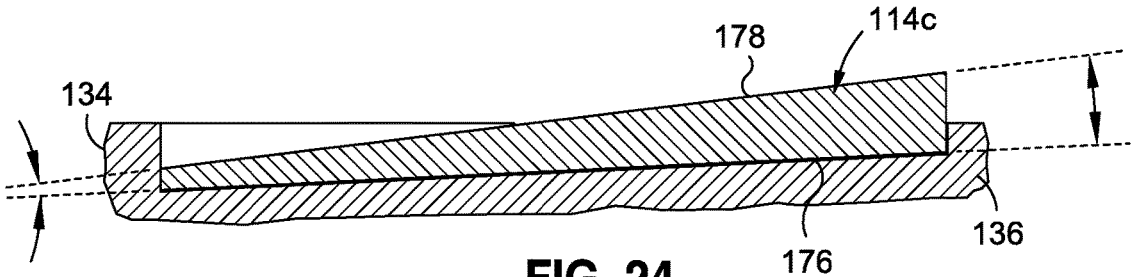
FIG. 24 is a cross sectional view of the club head depicted in FIGS. 21 and 22 taken within a second cross sectional plane to depict the rear plate coupled to the main body.

Referring now to FIGS. 18-20, there is shown a club head 110*b* as another species of the club head 110 and outfitted with a rear plate 114*b* as another species of the rear plate 114 and a sole plate 116*a* as another species of the sole plate 116. In the club head 110*b*, the rear plate 114*b* and sole plate 116*b* are each of a variable (e.g., non-uniform) thickness. Along these lines, the rear plate 114*b* includes a first surface 166 and an opposing second surface 168, wherein the distance between the first and second surfaces 166, 168 varies, with the distance being the smallest adjacent the partition 132, and the distance being the largest along the topline 118. In this regard, the rear plate 114*b* is considered to have a "vertical slant," as the thickness of the rear plate 114*b* varies in a generally vertical direction when the plate 114*b* is coupled to the main body 112 and the club head 110*b* is in the reference position. The vertical slant of the rear plate 114*b* results in more mass being positioned adjacent the topline 118 when the rear plate 114*b* is attached to the main body 112 so as to elevate the center of gravity of the club head 110*b*.

The sole plate 116*b* also includes a "vertical slant," which is defined by a first surface 170 and an opposing second surface 172, wherein the distance between the first and second surfaces 170, 172 varies, with the distance being the smallest adjacent the sole bottom surface 144, and the distance being the largest adjacent the partition 132. The vertical slant of the sole plate 116*b* results in more mass being positioned adjacent the partition 132 when the sole plate 116*b* is attached to the main body 112, so as to elevate the center of gravity of the club head 110*b*.

Although the embodiment shown in FIGS. 18-20 includes rear and sole plates 114*b*, 116*b* each having a thickness which increases in a generally upward direction (e.g., the portion of the plates 114*b*, 116*b* extending away from the sole 120 is the thickest), it is also contemplated that they may have the reverse configuration, with the thickness decreasing in a generally upward direction (e.g., the portion of the plates 114*b*, 116*b* extending toward the sole 120 is the thickest).

Referring now to FIGS. 21-24, there is shown a club head 110*c* as yet another species of the club head 110 and outfitted with a rear plate 114*c* as yet another species of the rear plate 114 and a sole plate 116*c* as yet another species of the sole plate 116. In the club head 110*c*, the rear plate 114*c* and sole plate 116*c* are each of a variable (e.g., non-uniform) thickness in a generally heel-to-toe direction. Along these lines, the rear plate 114*c* includes a first surface 176 and an opposing second surface 178, wherein the distance between the first and second surfaces 176, 178 varies, with the distance being the smallest adjacent the heel 134, and the distance being the largest adjacent the toe 136. Thus, when the rear plate 114*c* is attached to the main body 112, more mass is located adjacent the toe 136, which results in the center of gravity of the club head 110*c* being moved closer to the toe 136. By providing gradual thickness variation in the plate 114*c*, the location of the center of gravity may be shifted to the appropriate degree in a manner that does not detract from the traditional appearance of the club head or require plural components of varying density, which may raise the cost of manufacturing.

The sole plate 116*c* also includes a first surface 180 and an opposing second surface 182, wherein the distance between the first and second surfaces 180, 182 varies, with the distance being the least adjacent the heel 134, and the distance being the greatest adjacent the toe 136. Therefore, when the sole plate 116*c* is attached to the main body 112, more mass is located adjacent the toe 136, which results in the center of gravity of the club head 110*c* being moved closer to the toe 136.

Although FIGS. 21-24 show the rear and sole plates 114*c*, 116*c* as being thickest adjacent the toe 136, it is contemplated that they may be provided in the reverse configuration, with the plates 114*c*, 116*c* being thickest adjacent the heel 134.

The use of the rear and sole plates 114, 116 as shown in FIGS. 15-24 allows a user to adjust the weight and center of gravity of the club head 110. According to one embodiment, the center of gravity is spaced from a reference point by approximately 20.00-22.50 mm along the X-axis (i.e., to the right from the perspective shown in FIG. 17), 6.00-7.00 mm along the Y-axis (i.e., toward the heel), and 13.50-16.00 mm along the Z-axis (i.e., toward the topline). The variability of each dimension is dependent upon the configuration of the main body 112, as well as the material used for each insert. For instance, the plates 114, 116 may be formed from aluminum, tungsten, stainless steel, a material with anodized surfaces, tungsten impregnated with rubbers/polymers, or other materials known in the art. In this respect, the plates 114, 116 may be associated with different densities.

Although FIGS. 15-24 show the various rear plates 114 used in combination with the sole plates 116, it is also contemplated that the rear plate 114 may be used in combination with sole components 14 described above and shown in FIGS. 1-14 so as to enable further variation of bounce characteristics, as well as center of gravity or weight variation opposite the striking face. For example, the location of the center of gravity of a club head may be considered to affect the orientation in which the club head is permitted to rest when placed in its natural soled position. Also, the center of gravity of the club head affects the manner in which the club head dynamically responds to impact with a golf ball and/or with turf during a typical golf swing. For at least these reasons, the location of the center of gravity, in some embodiments, is preferably a factor in determining and assigning an effective bounce angle to a club head, such manner described above in further detail. Furthermore, when used in combination with the sole components 14 discussed above, the same tool may be used to attach/detach the rear plates 114 and sole components 14 to and from the main body 112, as well as for any removable shaft component if also incorporated into one or more embodiments. Along these lines, the plates 114, 116, sole component(s) 14, and/or adjustment tool may be packaged and sold collectively as a kit.

In addition, although the club head 110 shown in FIGS. 15-24 includes a single rear cavity 128 adapted to receive only one rear plate 114 at a time, and a single sole cavity 130 adapted to receive one sole plate 116 at a time, it is contemplated that other embodiments of the club head 110 include a main body 112 having a plurality of rear cavities, and a plurality of sole cavities, wherein each of the rear cavities is adapted to receive a respective rear plate, and each sole cavity is adapted to receive a plurality of sole plates. Thus, in a given club head 110, there may be a plurality of rear plates and a plurality of sole plates coupled to the main body 112.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An iron-type golf club head that, when oriented in a reference position relative to a virtual ground plane, comprises:

a main body including:

a striking face having a face center and a leading edge, the striking face being generally parallel to a virtual striking face plane;

a partition extending along opposing the striking face; and a hosel defining a hosel axis;

a rear component removably securable to the main body by association with a mechanical fastener;

a sole component removably securable to the main body in spaced relation to the rear component, with the partition separating the rear component and the sole component when the rear component and sole component are both secured to the main body, a portion of the sole component contacting the virtual ground plane at a ground contact point when the sole component is secured to the main body and the golf club head is in the reference position; and a sole surface formed by the main body and the sole component, the sole surface having a sole contour and a parting line formed between the sole component and the main body, such that, in a virtual central vertical plane passing through the face center and perpendicular to the virtual striking face plane, the parting line is spaced rearwardly from the striking face by a horizontal distance D5 that is no less than 0.35 in, the main body and the sole component defining a take-off angle in a virtual central vertical plane perpendicular to the striking face and passing through the ground contact point, the take-off angle being defined by a line passing through the leading edge and the ground contact point, and the virtual ground plane, the take-off angle being between 40-60 degrees.

2. The iron-type golf club head recited in claim 1, wherein:

at least a portion of the sole surface resides on the ground plane when the club head is in the reference position; and the main body, the rear component and the sole component are collectively configured to define a center of gravity spaced from the ground plane by between 13.50-16.00 mm.

3. The iron-type golf club head recited in claim 1, wherein the parting line, when measured in a direction perpendicular to the striking face, is spaced rearward from the striking face by a distance D1 and the club head has a maximum depth D2 such that D1/D2 is no less than 0.50.

4. The iron-type golf club head recited in claim 3, wherein D1/D2 is no less than 0.70.

5. The iron-type golf club head of claim 3, wherein, in the virtual central vertical plane, and measured in the direction perpendicular to the virtual striking face plane:

(a) the sole component further comprises a forward-most point defining a sole component forward plane parallel to the striking face plane and a rearward-most point defining a sole component rearward plane parallel to the striking face plane;

(b) a plane passing through the first parting line and parallel to the striking face plane is rearwardly spaced from the sole component forward plane by a distance D3; and (c) the sole component rearward plane is rearwardly spaced from the sole component forward plane by a distance D4 such that D3/D4 is no less than 0.30.

6. The iron-type golf club recited in claim 1, further comprising a loft angle no less than 38°.

7. The iron-type golf club head of claim 1, wherein D5 is between about 0.40 in and 0.70 in.

8. The iron-type golf club head of claim 1, wherein, in the virtual central vertical plane, the sole surface further comprises a sole surface horizontal length D6 such that D5/D6 is no less than 0.50.

9. The iron-type golf club head of claim 8, wherein D5/D6 is no less than 0.60.

10. The iron-type golf club head of claim 1, further comprising:

a virtual vertical hosel plane that includes the hosel axis; and a screw configured to secure the sole component to the main body, the screw having a screw head and a screw shaft defining a screw shaft axis that intersects the virtual hosel plane at a screw shaft angle of between about 75° and about 110°.

11. The iron-type golf club head of claim 1, further comprising an exposed rear surface opposite the striking face, at least a portion of the exposed rear surface being defined by the sole component.

* * * * *